US009484668B2

(12) United States Patent
Kamei et al.

(10) Patent No.: US 9,484,668 B2
(45) Date of Patent: Nov. 1, 2016

(54) CONNECTOR DEVICE

(71) Applicants: JAPAN AVIATION ELECTRONICS INDUSTRY, LIMITED, Shibuya-ku, Tokyo (JP); HONDA MOTOR CO., LTD., Minato-ku, Tokyo (JP)

(72) Inventors: Yuji Kamei, Tokyo (JP); Akira Kuwahara, Tokyo (JP); Makoto Kawahara, Tokyo (JP); Ryo Fujii, Tokyo (JP)

(73) Assignees: JAPAN AVIATION ELECTRONICS INDUSTRY, LIMITED, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/820,898

(22) Filed: Aug. 7, 2015

(65) Prior Publication Data

US 2016/0056573 A1 Feb. 25, 2016

(30) Foreign Application Priority Data

Aug. 19, 2014 (JP) ..... 2014-166462

(51) Int. Cl.
*H01R 24/00* (2011.01)
*H01R 13/629* (2006.01)
*H01R 13/502* (2006.01)
(Continued)

(52) U.S. Cl.
CPC ..... *H01R 13/62977* (2013.01); *H01R 13/502* (2013.01); *H01R 13/62938* (2013.01); *H01R 13/62955* (2013.01); *H01R 13/635* (2013.01);
(Continued)

(58) Field of Classification Search
CPC ..... H01R 13/62938; H01R 13/658; H01R 13/26; H01R 13/62955; H01R 13/62933; H01R 13/62905; H01R 23/7005
USPC ..... 439/660, 157
See application file for complete search history.

(56) References Cited

U.S. PATENT DOCUMENTS 4,919,047 A * 4/1990 Inouye ..... B41L 17/18 101/175
5,443,393 A * 8/1995 Okumura ..... H01R 13/62938 439/157

(Continued)

FOREIGN PATENT DOCUMENTS

JP 2002343169 A 11/2002
JP 2011124225 A 6/2011
JP 2013016426 A 1/2013

*Primary Examiner* — Abdullah Riyami
*Assistant Examiner* — Vladimir Imas
(74) *Attorney, Agent, or Firm* — Holtz, Holtz & Volek PC

(57) ABSTRACT

A connector device comprises a connector and a mating connector connectable with each other. The mating connector comprises a mating primary terminal and a mating secondary terminal. The connector comprises a primary terminal, a secondary terminal, an operation member and a push-back mechanism. The operation member changes its state from an initial state to a second state via a second state. When the state of the operation member is changed to the first state, the primary terminal is connected to the mating primary terminal. When the state of the operation member is changed to the second state, the secondary terminal is connected to the mating secondary terminal. When the state of the operation member is changed to the first state, the push-back mechanism applies a push-back force to the operation member to change the state of the operation member back toward the initial state.

10 Claims, 15 Drawing Sheets

(51) Int. Cl.
*H01R 13/635* (2006.01)
*H01R 31/08* (2006.01)

(52) U.S. Cl.
CPC ..... *H01R 24/005* (2013.01); *H01R 31/08* (2013.01); *H01R 2201/26* (2013.01)

(56) References Cited

U.S. PATENT DOCUMENTS 5,593,309 A * 1/1997 Post ..... H01R 13/62905 439/157
6,325,648 B1 * 12/2001 Bilezikjian ..... H01R 13/62938 439/157
6,558,176 B1 * 5/2003 Martin ..... H01R 13/62944 439/157
6,755,673 B2 6/2004 Fukushima et al.
6,863,551 B2 * 3/2005 Fukamachi ..... H01R 13/64 439/157
7,011,536 B2 * 3/2006 Okamoto ..... H01R 13/62911 439/157
7,063,548 B2 * 6/2006 Ohara ..... H01R 13/641 439/157
7,670,159 B2 * 3/2010 Shamoto ..... H01R 13/62938 439/157
7,872,206 B2 * 1/2011 Matsunaga ..... B60L 3/00 200/335
8,075,351 B2 * 12/2011 Park ..... H01R 13/40 439/372
8,303,320 B2 11/2012 Loncar et al.
9,048,045 B2 * 6/2015 Henmi ..... H01R 13/62933
9,122,299 B2 * 9/2015 Martin ..... G05G 1/04
9,325,112 B2 * 4/2016 Tabata ..... H01R 13/62905
2005/0098419 A1 * 5/2005 Matsui ..... H01R 13/62933 200/311
2011/0117761 A1 * 5/2011 Loncar ..... H01R 13/516 439/157

* cited by examiner

CONNECTOR DEVICE

CROSS REFERENCE TO RELATED APPLICATIONS

Applicants claim priority under 35 U.S.C. §119 of Japanese Patent Application No. JP2014-166462 filed Aug. 19, 2014.

BACKGROUND OF THE INVENTION

This invention relates to a connector device and, in particular, to a connector device which is attached to an electric car or a hybrid car to relay electric power supplied from a power source system.

For example, this type of connector device is disclosed in JP-A 2002-343169 (Patent Document 1), the content of which is incorporated herein by reference.

As shown in FIG. 29A, the connector device disclosed in Patent Document 1 comprises a connector 910 and a mating connector 950. The mating connector 950 comprises a mating sub connector 952. The mating connector 950 holds a mating primary terminal (not shown), and the mating sub connector 952 holds a mating secondary terminal (not shown). The connector 910 comprises a connector housing (housing) 912, a sub connector 914 and a lever (operation member) 916. The housing 912 holds a primary terminal (not shown), and the sub connector 914 holds a secondary terminal (not shown).

As shown in FIGS. 29A and 29B, a turning operation that turns the operation member 916 in a turning direction DR changes a state of the operation member 916 from an initial state to a first state, or from the state shown in FIG. 29A to the state shown in FIG. 29B. When the state of the operation member 916 is changed into the first state, the connector housing 912 is moved downward in an upper-lower direction (Z-direction) so that the primary terminal (not shown) of the connector 910 is connected to the mating primary terminal (not shown) of the mating connector 950. As shown in FIGS. 29B and 29C, subsequent to the turning operation, a sliding operation that makes the operation member 916 slide in a sliding direction Ds changes the state of the operation member 916 from the first state to a second state, or to the state shown in FIG. 29C. When the state of the operation member 916 is changed into the second state, the sub connector 914 is moved downward so that the secondary terminal (not shown) of the connector 910 is connected to the mating secondary terminal (not shown) of the mating connector 950. As a result, an electric current begins to flow.

FIGS. 29B and 29C show that the first state and the second state of the operation member 916 are visually confused with each other. Accordingly, in such a case where the operation is suspended at the time when the operation member 916 is turned, an operator might misunderstand as if the lever 916 is already made slide so that the operation is completed. Unless such misunderstanding is made clear, the electric current will never flow.

SUMMARY OF THE INVENTION

It is therefore an object of the present invention to provide a connector device which comprises a connector and a mating connector connectable with each other via two or more operations of the operation member and which easily allows visual recognition of whether the operation of the operation member is completed or not.

One aspect of the present invention provides a connector device comprising a connector and a mating connector connectable with each other. The mating connector comprises a mating housing, a mating primary terminal and a mating secondary terminal. The mating primary terminal and the mating secondary terminal are held by the mating housing. The connector comprises a housing, a primary terminal, a secondary terminal, an operation member and a push-back mechanism. The primary terminal is held by the housing. The operation member is attached to the housing. A movement of a part or whole of the operation member relative to the housing causes a state of the operation member to be changed from an initial state to a first state, and another movement of a part or whole of the operation member relative to the housing causes the state of the operation member to be changed from the first state to a second state. When the operation member is in the initial state, the primary terminal is unconnected to the mating primary terminal, and the secondary terminal is unconnected to the mating secondary terminal. When the state of the operation member is changed from the initial state to the first state, the primary terminal is moved relative to the mating primary terminal to be connected to the mating primary terminal. When the state of the operation member is changed from the first state to the second state, the secondary terminal is moved relative to the mating secondary terminal to be connected to the mating secondary terminal. When the state of the operation member is changed to the first state, the push-back mechanism applies a push-back force to the operation member, wherein the push-back force pushes back the operation member to change the state of the operation member back toward the initial state.

According to the present invention, the operation of the operation member is completed when the state of the operation member is changed from the initial state to the second state via the first state. When the state of the operation member is changed to the first state, the push-back mechanism applies the push-back force to the operation member, wherein the push-back force pushes back the operation member to change the state of the operation member back toward the initial state. The operation member is therefore actually pushed back and changes its state toward the initial state if the operation of the operation member is suspended. The connector device thus easily allows visual recognition of whether the operation of the operation member is completed or not.

An appreciation of the objectives of the present invention and a more complete understanding of its structure may be had by studying the following description of the preferred embodiment and by referring to the accompanying drawings.

Figure 1:
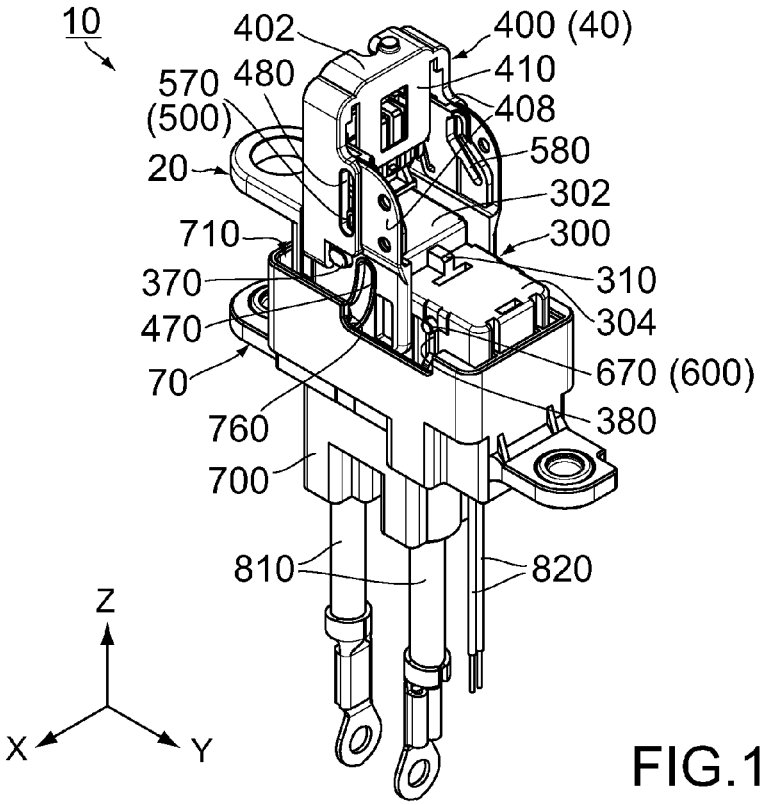
FIG. 1 is a perspective view showing a connector device according to an embodiment of the present invention, wherein an operation member of a connector of the connector device is in an initial state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector device 10 according to an embodiment of the present invention is to be installed to an object (not shown) such as an electric car to transmit electric power supplied from an electric source system (not shown), for example, to a motor (not shown). However, the present invention is also applicable to a connector device unlike the connector device 10 which transmits the electric power.

As can be seen from FIGS. 1 to 7, the connector device 10 according to the present embodiment comprises a connector 20 and a mating connector 70 connectable with each other.

Figure 3:
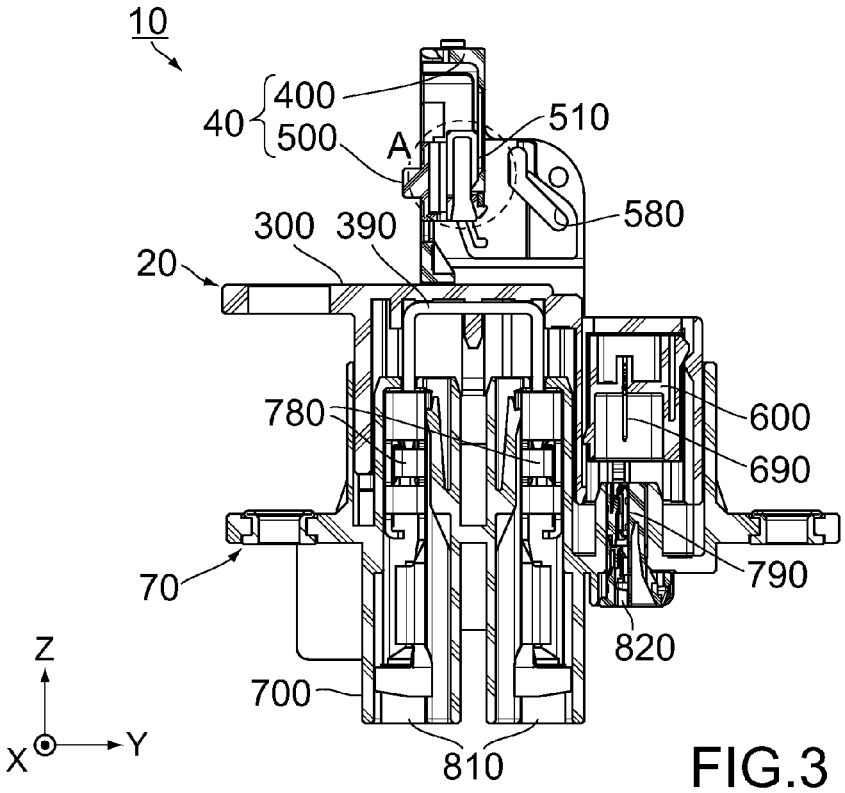
FIG. 3 is a partially cut-away view showing the connector device of FIG. 2, taken along line III-III, wherein a primary terminal and a secondary terminal of the connector and a mating primary terminal and a mating secondary terminal of a mating connector are illustrated not in cross-sectional views but in side views.

Referring to FIG. 3, the mating connector 70 comprises a mating housing 700 made of insulator, two mating primary terminals 780 each made of conductor and two mating secondary terminals 790 each made of conductor. The mating primary terminals 780 and the mating secondary terminals 790 are held by the mating housing 700. The mating primary terminals 780 are connected to an electric power circuit (not shown) via cables 810. The mating secondary terminal 790 are connected to a switch (not shown) of the electric power circuit via cables 820.

Figure 2:
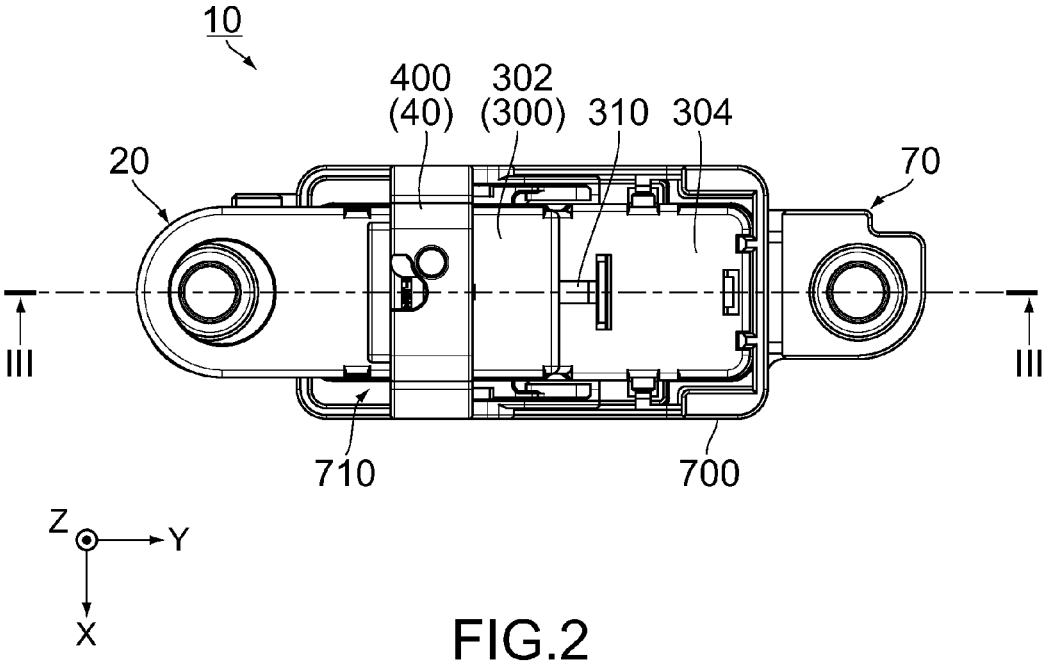
FIG. 2 is a top view showing the connector device of FIG. 1.

As can be seen from FIGS. 1 to 3, the mating housing 700 has a box-like shape which is long in a front-rear direction (Y-direction) and is short in a width direction (X-direction). The mating housing 700 has an accommodation portion (accommodation space) 710 which is formed therewithin and opens upward in an upper-lower direction (Z-direction), or opens in the positive Z-direction. Referring to FIG. 1, the mating housing 700 has two first cam projections 760. The first cam projections 760 are provided to opposite sidewalls of the accommodation portion 710 in the X-direction, respectively, and project inward in the X-direction.

Referring to FIG. 3, the connector 20 comprises a housing 300 made of insulator, a primary terminal 390 made of conductor, an operation member 40 made of insulator, a sub connector 600 made of insulator and a secondary terminal 690 made of conductor. The sub connector 600 is attached to the housing 300. The primary terminal 390 is held by the housing 300, and the secondary terminal 690 is held by the sub connector 600.

Figure 4:
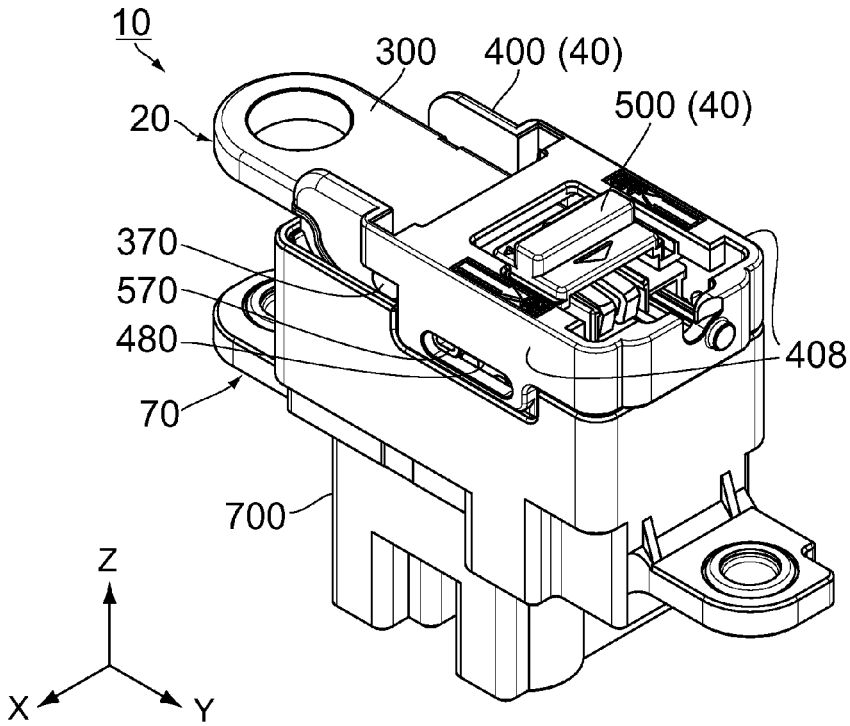
FIG. 4 is a perspective view showing the connector device of FIG. 1, wherein the operation member of the connector is in a first state while taking a controlled posture, and cables extending outward from the mating connector are not illustrated.

As can be seen from FIGS. 1, 3 and 4, the operation member 40 is attached to the housing 300. In detail, the operation member 40 according to the present embodiment includes a lever 400 and a slider 500. The lever 400 is attached to the housing 300, and the slider 500 is attached to the lever 400.

As can be seen from FIGS. 1 to 7, the operation member 40 is movable relative to the housing 300. In detail, as can be seen from FIGS. 1 to 5, the lever 400 is movable between a first position (the position shown in FIGS. 1 to 3) and a second position (the position shown in FIGS. 4 and 5) together with the slider 500, wherein each of the first position and the second position is a position relative to the housing 300. In addition, as can be seen from FIGS. 4 to 7, the slider 500 is solely movable between a first relative position (the position shown in FIGS. 4 and 5) and a second relative position (the position shown in FIGS. 6 and 7), wherein each of the first relative position and the second relative position is a position relative to the lever 400.

Figure 5:
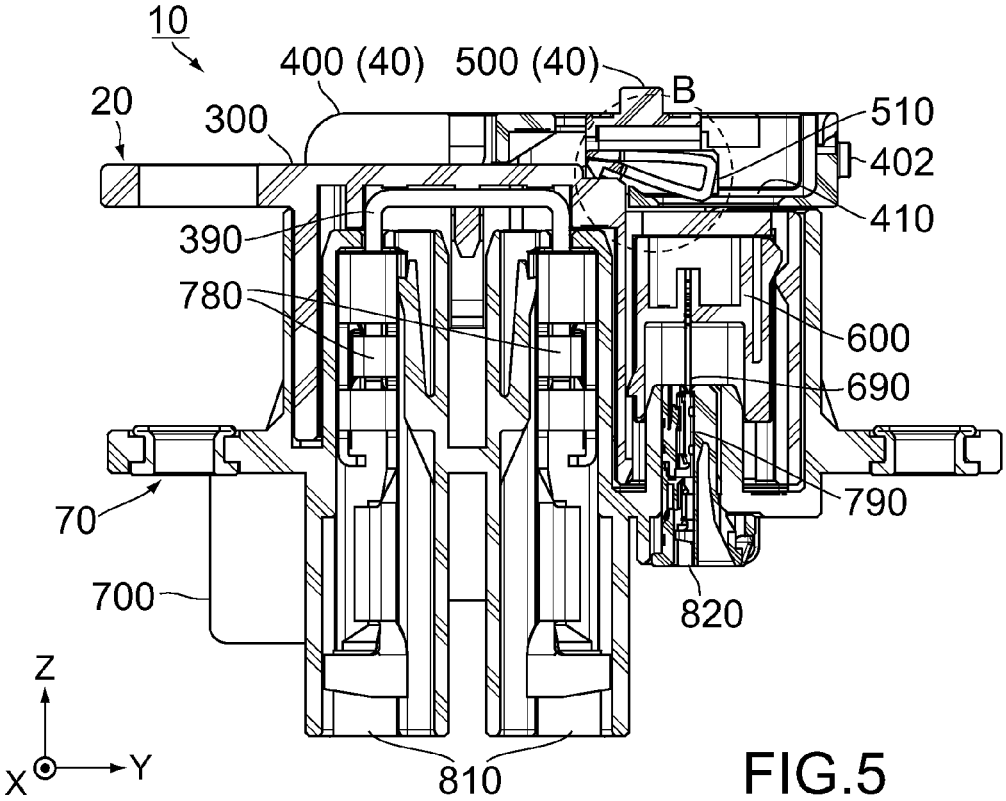
FIG. 5 is a partially cut-away view showing the connector device of FIG. 4, wherein illustrated cross-sections correspond to the cross-sections of FIG. 3.
Figure 7:
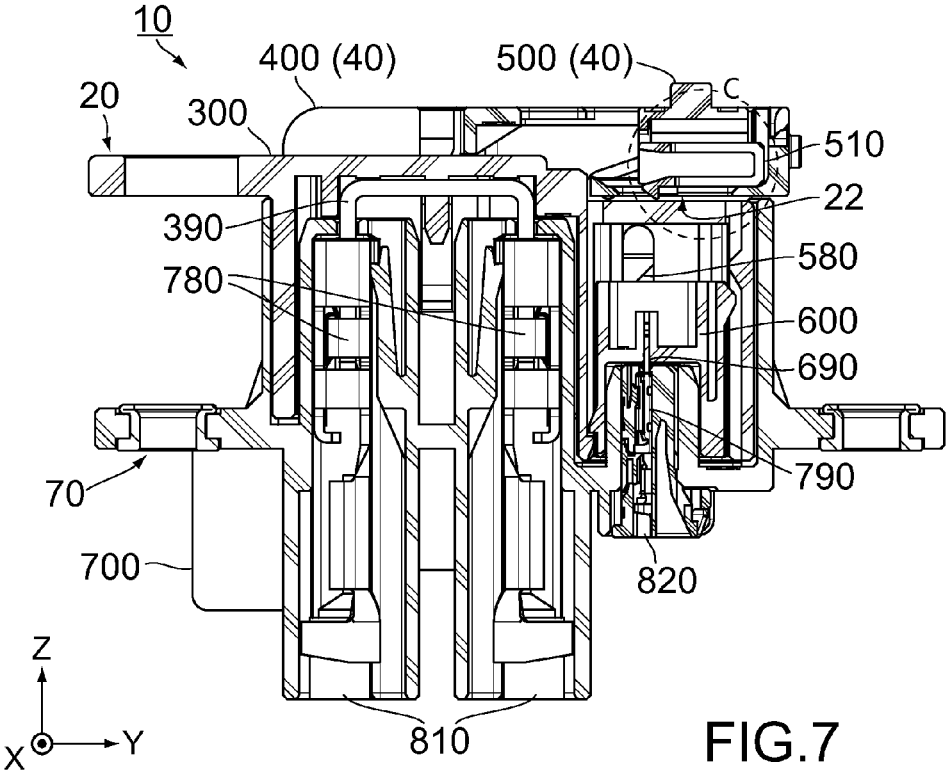
FIG. 7 is a partially cut-away view showing the connector device of FIG. 6, wherein illustrated cross-sections correspond to the cross-sections of FIG. 3.

As can be seen from FIGS. 3, 5 and 7, the movement of the operation member 40 relative to the housing 300 causes the housing 300 to be moved relative to the mating housing 700. The subsequent movement of the operation member 40 relative to the housing 300 causes the sub connector 600 to be moved relative to the mating housing 700.

Hereafter, explanation will be made about detailed structure of the connector 20 in relation to the aforementioned relative movements.

Figure 8:
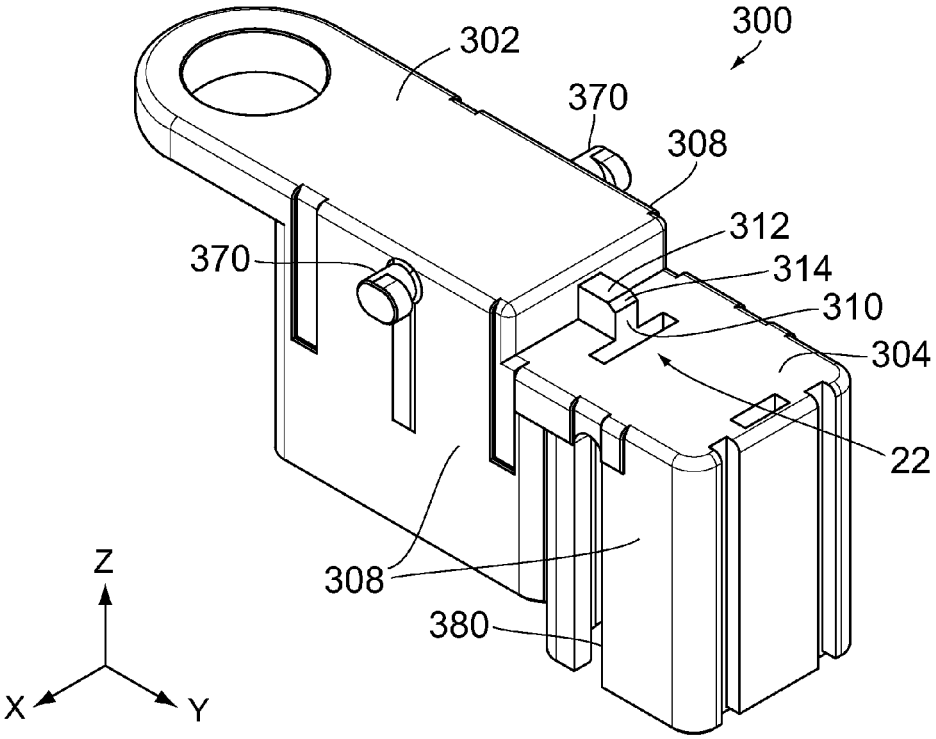
FIG. 8 is a perspective view showing a housing of the connector of the connector device of FIG. 6.

Referring to FIG. 8, the housing 300 has a box-like shape which is long in the Y-direction and is short in the X-direction. As can be seen from FIG. 3, the housing 300 has an inner space which opens downward, or opens in the negative Z-direction. Referring to FIG. 8, the housing 300 has two sidewalls 308. The sidewalls 308 are located at opposite sides of the housing 300 in the X-direction, respectively. Each of the sidewalls 308 is formed with a support axis 370 and a guide channel 380. The support axis 370 projects outward in the X-direction. The guide channel 380, which is a slit across the sidewall 308 in the X-direction, extends upward from a lower end, or the negative Z-side end, of the sidewall 308.

As shown in FIGS. 9 to 12, the lever 400 has a front wall 402 and two sidewalls 408. The sidewalls 408 are located at opposite sides of the lever 400 in the X-direction, respectively. The front wall 402 couples the two sidewalls 408 to each other in the X-direction. Each of the sidewalls 408 is formed with a support hole 460, a first cam groove 470 and a slide channel 480. The support hole 460 pierces the sidewall 408 in the X-direction. The first cam groove 470 is a recess which is recessed inward in the X-direction, and the slide channel 480 is a slit across the sidewall 408 in the X-direction. As can be seen from FIGS. 1 and 9, when the lever 400 is located at the first position, or the position shown in FIG. 1, the first cam groove 470 opens downward and extends obliquely upward to the vicinity of the support hole 460. As shown in FIG. 4, when the lever 400 is located at the second position, the slide channel 480 extends in the Y-direction.

Figure 13:
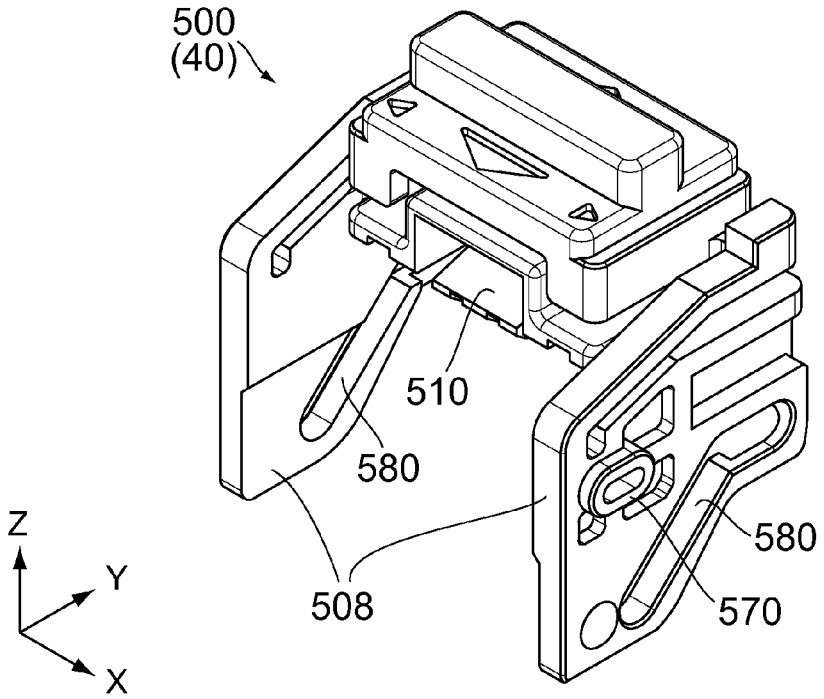
FIG. 13 is a perspective view showing a slider of the connector of the connector device of FIG. 6.
Figure 14:
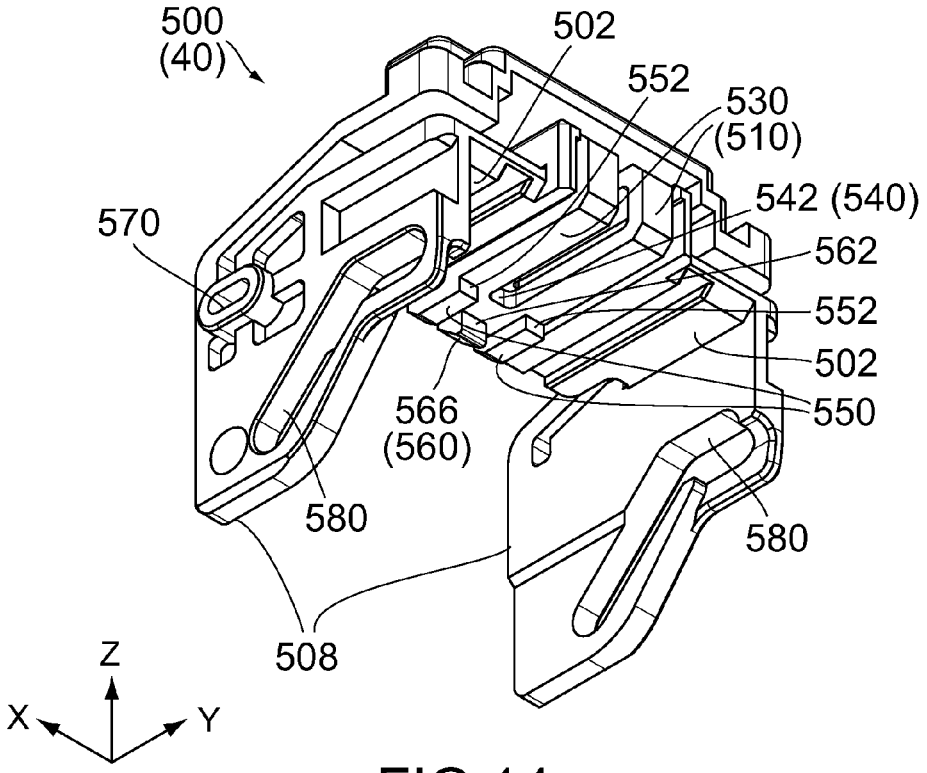
FIG. 14 is another perspective view showing the slider of FIG. 13.
Figure 15:
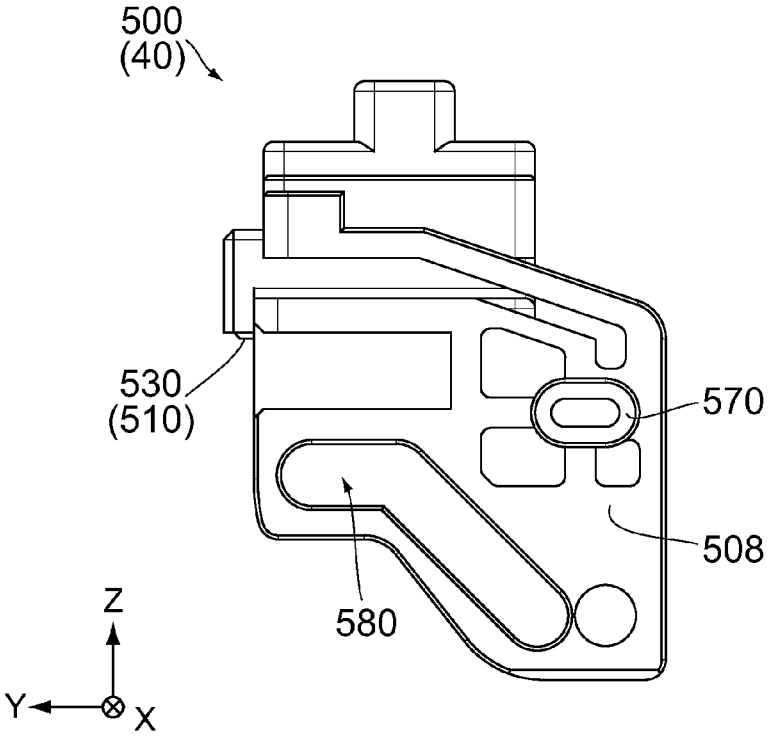
FIG. 15 is a side view showing the slider of FIG. 13.

As shown in FIGS. 13 to 15, the slider 500 has a coupling portion 502 and two sidewalls 508. The sidewalls 508 are located at opposite sides of the slider 500 in the X-direction, respectively. The coupling portion 502 couples the two sidewalls 508 to each other in the X-direction. Each of the sidewalls 508 is formed with a slide projection 570 and a second cam groove 580. The slide projection 570 projects outward in the X-direction. The second cam groove 580 is a slit across the sidewall 508 in the X-direction.

As can be seen from FIGS. 1 and 4, the slider 500 is attached between the two sidewalls 408 of the lever 400. In detail, the two slide projections 570 of the slider 500 are inserted into the two slide channels 480 of the lever 400, respectively. The slider 500 is therefore sandwiched between the two sidewalls 408, and each of the slide projections 570 is located at one of ends of the corresponding slide channel 480, or at the negative Y-side end in FIG. 4. As described later, a second operation can move the slider 500 from this first relative position toward the second relative position along the slide channel 480.

As can be seen from FIGS. 1 and 4, the lever 400 together with the slider 500 attached thereto is attached to the housing 300 so as to sandwich the housing 300 in the X-direction. In detail, the two support axes 370 of the housing 300 are inserted into the two support holes 460 (see FIG. 9) of the lever 400, respectively. The housing 300 is therefore sandwiched between the two sidewalls 408 of the lever 400. The lever 400 is turnable about the support axes 370. More specifically, a first operation described later can rotationally move the lever 400 from this first position toward the second position.

Referring to FIG. 1, the sub connector 600 has two second cam projections 670. The second cam projections 670 are located at opposite sides of the sub connector 600 in the X-direction, respectively. The second cam projections 670 project outward in the X-direction. The sub connector 600 is accommodated and attached in the inner space of the housing 300. In detail, the two second cam projections 670 of the sub connector 600 are inserted into the guide channels 380 of the housing 300, respectively. The thus-attached sub connector 600 is movable along the guide channels 380. The second cam projections 670 pass through the guide channels 380, respectively, to project outward from the housing 300.

As can be seen from FIGS. 1 and 2, the connector 20 has a lower part, or the negative Z-side part, which has a size in the XY-plane slightly smaller than another size of the accommodation portion 710 of the mating housing 700 in the XY-plane. The connector 20 can be therefore inserted into the accommodation portion 710 along a connection direction (negative Z-direction).

Hereafter, more specific explanation will be made on how the connector 20 and the mating connector 70 are connected with each other.

First, as can be seen from FIG. 1, the connector 20 is placed above the mating connector 70 under a state where the operation member 40 including the lever 400 and the slider 500 extends upward from the housing 300. Then, the connector 20 is inserted into the accommodation portion 710 along the negative Z-direction while positioned in the XY-plane properly. This insertion causes the first cam projections 760 of the mating housing 700 to be received in lower ends of the first cam grooves 470 of the lever 400, respectively. The state which the operation member 40 takes at that time is referred to as "initial state". The operation member 40 in the initial state stands upright with respect to the housing 300. When the operation member 40 is in the initial state, the lever 400 is located at the first position and the slider 500 is located at the first relative position.

As can be seen from FIG. 3, when the operation member 40 is in the initial state, the primary terminal 390 is unconnected to the mating primary terminals 780. The mating primary terminals 780 are therefore disconnected from each other so that the electric power circuit (not shown) is broken. In the meantime, the mating secondary terminals 790 are also disconnected from each other because the secondary terminal 690 is similarly unconnected to the mating secondary terminals 790. In other words, the initial state is a state where the operation member 40 completely electrically disconnects the connector 20 and the mating connector 70 from each other.

As can be seen from FIGS. 1 and 3 to 5, the first operation of the operation member 40 under the initial state turns the lever 400 about the support axes 370, wherein the first operation is an operation which turns the front wall 402 of the lever 400 forward and downward, or along the positive Y-direction and the negative Z-direction. During the first operation, the first cam projections 760 of the mating housing 700 are located at predetermined positions with no movement. Accordingly, the lever 400 is moved downward while bringing lower edges, or the negative Z-side edges, of the first cam grooves 470 into contact with the first cam projections 760, respectively. The support axes 370 are pressed downward because of the downward movement of the lever 400 so that the housing 300 is moved downward together with the lever 400. When the first operation is completed, the first cam projections 760 are located at ends of the first cam grooves 470, respectively. The state which the operation member 40 takes at the time when the first operation is completed is referred to as "first state". When the state of the operation member 40 is changed from the initial state to the first state, the lever 400 is moved to the second position but the slider 500 remains at the first relative position.

As shown in FIG. 4, when the first operation is just completed, the operation member 40 extends long along the Y-direction. At that time, as can be seen from FIGS. 1 and 4, the second cam projections 670 of the sub connector 600 are received in upper ends, or the positive Z-side ends, of the second cam grooves 580 of the slider 500, respectively.

As can be seen from FIGS. 3 and 5, the first operation moves the primary terminal 390 downward. When the first operation is completed, the primary terminal 390 is connected to the mating primary terminals 780. In other words, when the state of the operation member 40 is changed from the initial state to the first state, the primary terminal 390 is moved relative to the mating primary terminals 780 to be connected to the mating primary terminals 780. The mating primary terminals 780 are therefore connected with each other to complete the electric power circuit (not shown). However, the mating secondary terminals 790 are not connected with each other because the secondary terminal 690 is not connected to the mating secondary terminals 790. No electric current therefore flows. In other words, the first state is a state where the operation member 40 partially electrically connects the connector 20 and the mating connector 70 with each other.

As can be seen from the above explanation, the state of the operation member 40 according to the present embodiment is changeable from the initial state (the state shown in FIGS. 1 to 3) to the first state (the state shown in FIGS. 4 and 5). In detail, a movement of whole of the operation member 40, or a movement of the lever 400 together with the slider 500, relative to the housing 300 causes the state of the operation member 40 to be changed from the initial state to the first state.

Figure 6:
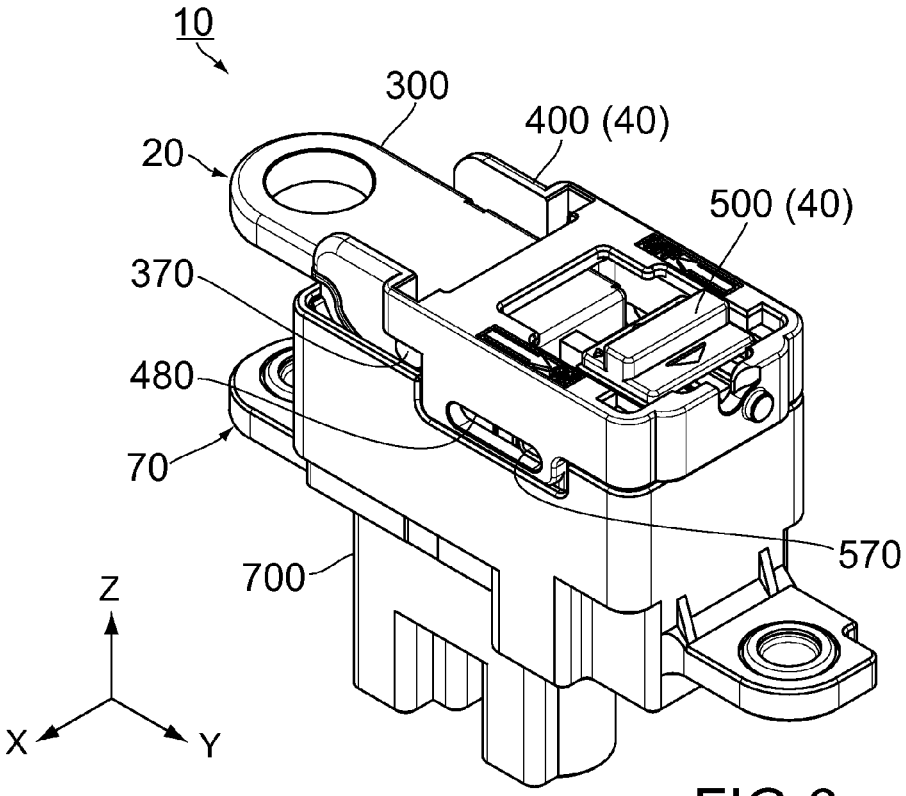
FIG. 6 is a perspective view showing the connector device of FIG. 1, wherein the operation member of the connector is in a second state, and the cables extending outward from the mating connector are not illustrated.

As can be seen from FIGS. 4 and 6, the second operation of the operation member 40 under the first state moves each of the slide projections 570 from a rear end to a front end, or from the negative Y-side end to the positive Y-side end, of the corresponding slide channel 480, wherein the second operation is an operation which makes the slider 500 slide forward. Referring to FIG. 1 as well as FIGS. 4 and 6, during the second operation, the second cam projections 670 of the sub connector 600 are moved along the second cam grooves 580 of the slider 500, respectively. Accordingly, as can be seen from FIGS. 5 and 7, the sub connector 600 is moved downward. Referring to FIGS. 4 and 6, when the slide projections 570 arrive at the front ends of the slide channels 480, the second operation is completed. The state which the operation member 40 takes at the time when the second operation is completed is referred to as "second state". When the state of the operation member 40 is changed from the first state to the second state, the slider 500 is moved forward in the Y-direction from the first relative position to the second relative position. In the meantime, the lever 400 remains at the second position. In other words, when the state of the operation member 40 is changed to the second state, the lever 400 remains at the second position but the slider 500 is moved to the second relative position.

As can be seen from FIGS. 5 and 7, the second operation does not move the primary terminal 390. The electric power circuit (not shown) is therefore maintained. In the meantime, the second operation moves the secondary terminal 690 downward. When the second operation is completed, the secondary terminal 690 is connected to the mating secondary terminals 790. In other words, when the state of the operation member 40 is changed from the first state to the second state, the secondary terminal 690 is moved relative to the mating secondary terminals 790 to be connected to the mating secondary terminals 790. The mating secondary terminals 790 are therefore connected with each other to close the switch (not shown) of the electric power circuit (not shown). As a result, the electric current begins to flow. In other words, the second state is a state where the operation member 40 completely electrically connects the connector 20 and the mating connector 70 with each other.

As can be seen from the above explanation, the state of the operation member 40 according to the present embodiment is changeable from the first state (the state shown in FIGS. 4 and 5) to the second state (the state shown in FIGS. 6 and 7). In detail, a movement of a part of the operation member 40, or a movement of the slider 500, relative to the housing 300 causes the state of the operation member 40 to be changed from the first state to the second state.

As can be seen from FIGS. 1 to 7, the connector 20 can be removed from the mating connector 70 when the aforementioned operations are performed in reverse sequence. In detail, first, the slider 500 is moved from the second relative position to the first relative position so that the state of the operation member 40 is changed from the second state to the first state. This operation disconnects the secondary terminal 690 from the mating secondary terminals 790 to stop the electric current. Then, the lever 400 is turned up to be moved from the second position to the first position so that the state of the operation member 40 is changed from the first state to the initial state. This operation disconnects the primary terminal 390 from the mating primary terminals 780 to break the electric power circuit (not shown). When the operation member 40 returns to the initial state, the connector 20 can be removed upward from the mating connector 70.

The connector device 10 formed as described above can be modified variously.

Figure 11:
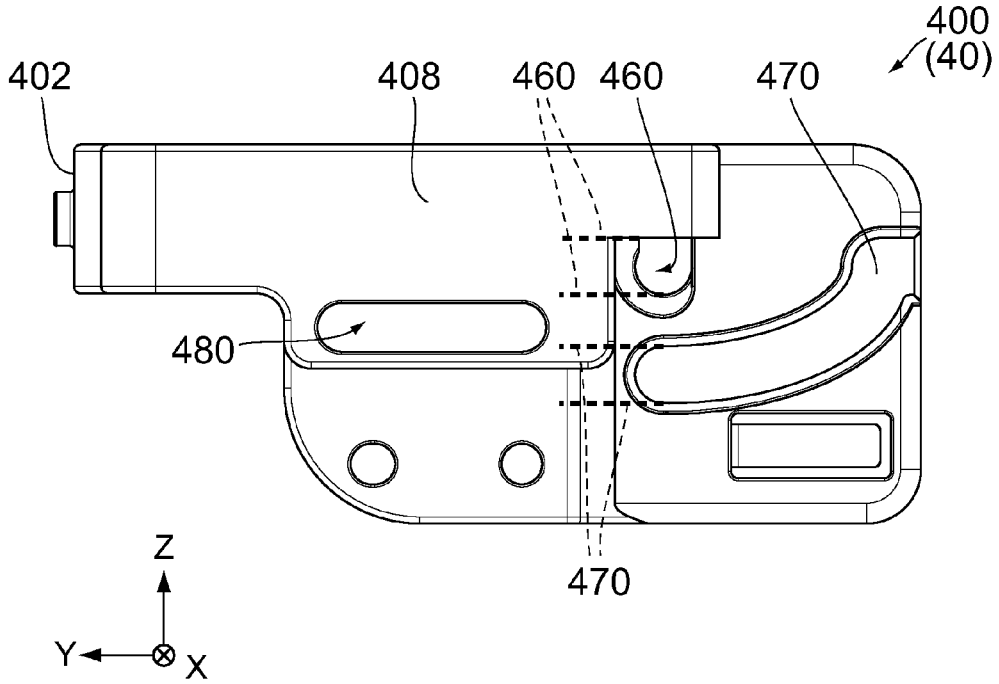
FIG. 11 is a side view showing the lever of FIG. 9, wherein dashed line illustrates a modification of the lever, especially, a part of an outline of an extended part of a first cam groove and a part of an outline of an extended part of a support hole.

Referring to FIGS. 3, 5 and 7, the lever 400 and the slider 500 may be formed integrally with each other. In other words, the operation member 40 may be formed only of the lever 400 which allows both the first operation and the second operation. Referring to FIG. 11 as well as FIGS. 3, 5 and 7, when the operation member 40 is thus formed, the structure of each of the sidewalls 408 of the lever 400 may be slightly modified. For example, the support hole 460 and the first cam groove 470 may be made longer so as to extend forward. This structure allows the state of the operation member 40 to be changed from the first state to the second state with no movement of the housing 300, in particular, with no movement of the primary terminal 390. When the operation member 40 is thus-modified, a movement of whole of the operation member 40 relative to the housing 300 causes the state of the operation member 40 to be changed from the initial state to the first state, and another movement of whole of the operation member 40 relative to the housing 300 causes the state of the operation member 40 to be changed from the first state to the second state.

When the operation member 40 is in the initial state, the slider 500 may be coupled to the sub connector 600 without being attached to the lever 400. For example, each of the slide projections 570 may be formed to be inserted into the corresponding slide channel 480 as a result of the change of the state of the operation member 40 into the first state. In this case, when the state of the operation member 40 is changed from the initial state to the first state, only a part of the operation member 40, or only the lever 400, is moved relative to the housing 300. In addition to the aforementioned modifications, the operation member 40 may includes any one or more operational members instead of and different from the lever 400 and the slider 500. Moreover, the operation member 40 may be formed of only one member or formed of three or more members.

As can be seen from the above explanation, according to the present invention, a movement of a part or whole of the operation member 40 relative to the housing 300 causes the state of the operation member 40 to be changed from the initial state to the first state, and another movement of a part or whole of the operation member 40 relative to the housing 300 causes the state of the operation member 40 to be changed from the first state to the second state. In other words, the connector 20 can be connected with the mating connector 70 via the two operations. However, the connector 20 may be connected with the mating connector 70 via three or more operations. Moreover, operations of the operation member 40 may be different from the aforementioned first and second operations.

Hereafter, more details will be explained about the housing 300 and the operation member 40 according to the present embodiment.

As shown in FIG. 8, the housing 300 has an upper surface 302 and a step surface 304. Each of the upper surface 302 and the step surface 304 is a horizontal plane in parallel to the XY-plane. The housing 300 is provided with a step formed between the upper surface 302 and the step surface 304. In detail, the step surface 304 is located below the upper surface 302. Referring to FIGS. 7 and 8, the connector 20 is provided with a receiving space 22 because of the thus-formed step. In the present embodiment, the receiving space 22 opens in the XY-plane and opens upward. However, the receiving space 22 may be enclosed by a wall in the XY-plane, provided that the receiving space 22 opens upward.

The step surface 304 of the housing 300 is provided with a projecting portion 310. The projecting portion 310 projects upward in the Z-direction from the step surface 304. The projecting portion 310 is formed with an upper surface 312 and a slope 314. The upper surface 312 is a horizontal plane located at an upper end of the projecting portion 310. The slope 314 is formed at a front side, or the positive Y-side, of the projecting portion 310. In other words, the projecting portion 310 has the front side formed with the slope 314. The slope 314 extends forward and downward from the upper surface 312. In other words, the slope 314 intersects with both the Y-direction and the Z-direction.

Figure 9:
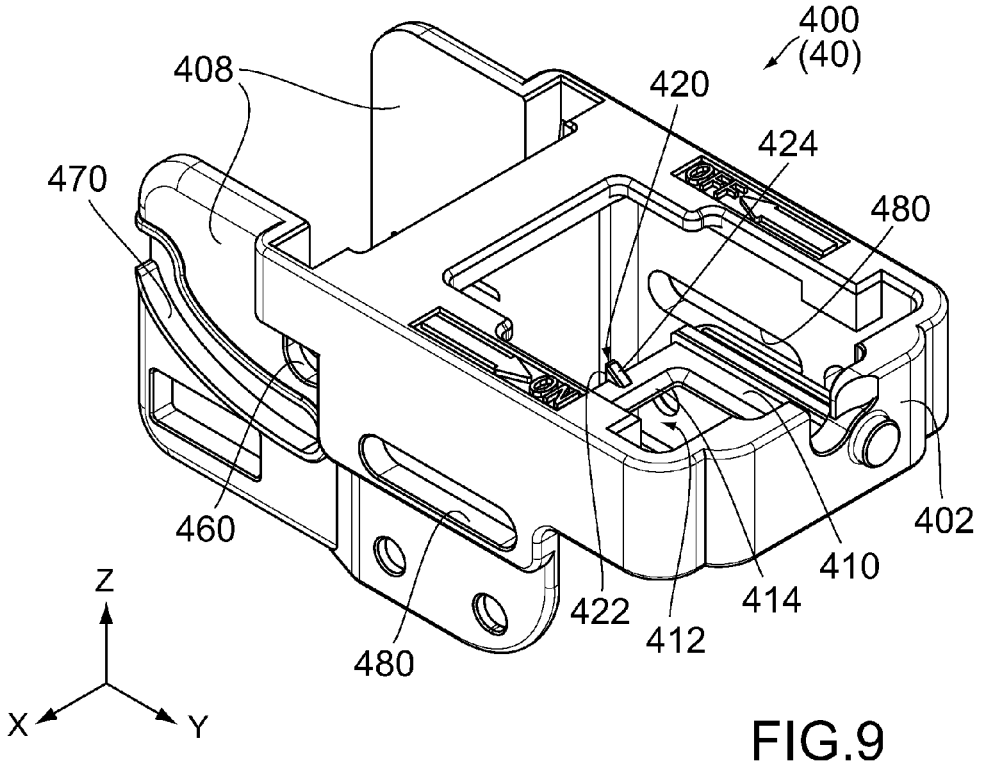
FIG. 9 is a perspective view showing a lever of the connector of the connector device of FIG. 6.
Figure 10:
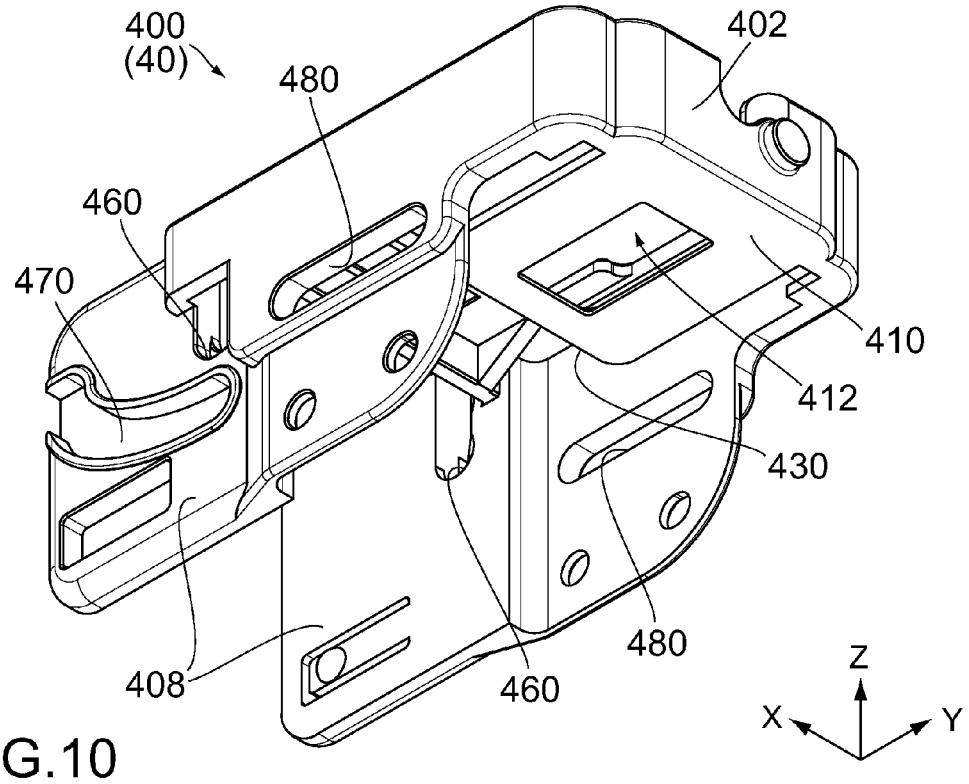
FIG. 10 is another perspective view showing the lever of FIG. 9.
Figure 12:
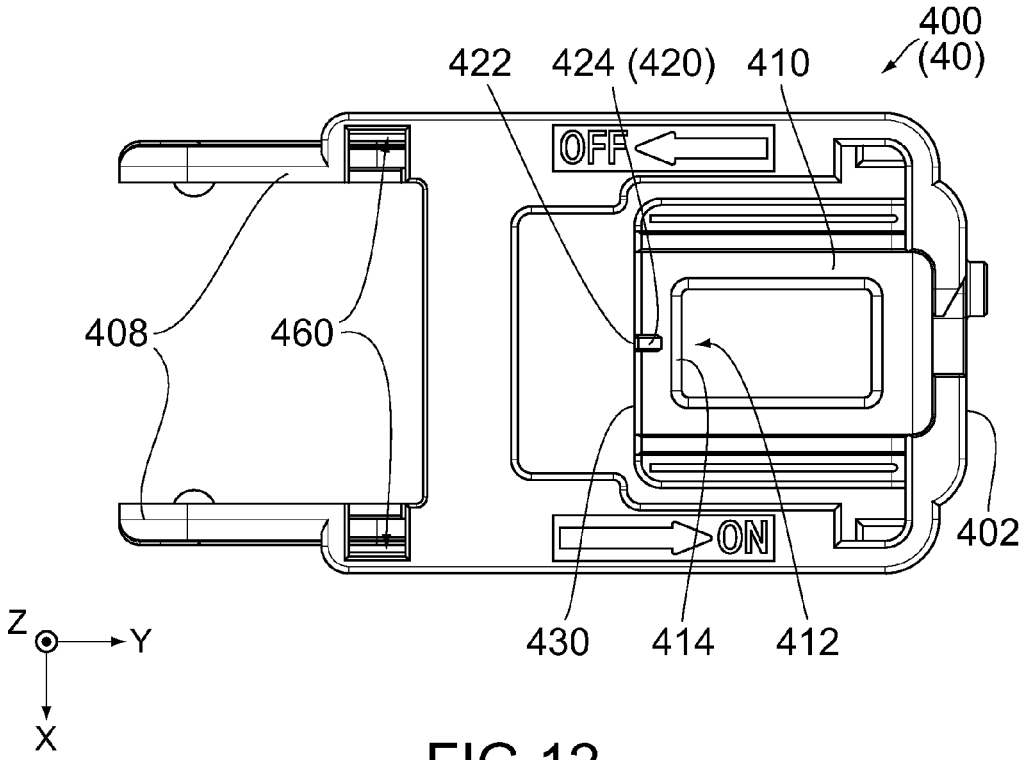
FIG. 12 is a top view showing the lever of FIG. 9.

As shown in FIGS. 9, 10 and 12, the lever 400 has a support piece 410. The support piece 410 has a rectangular flat plate-like shape. As shown in FIG. 5, when the lever 400 is located at the second position, the support piece 410 extends rearward, or in the negative Y-direction, from the front wall 402. Hereafter, explanation will be made about various parts of the support piece 410 while using directions and positional relations under a state where the lever 400 is located at the second position.

As shown in FIGS. 9, 10 and 12, the support piece 410 is formed with a receiving portion 412. The receiving portion 412 is a rectangular hole which pierces the support piece 410 in the Z-direction. The receiving portion 412 has a rear end formed with a slope 414. The slope 414 intersects with both the Y-direction and the Z-direction.

As shown in FIGS. 9 and 12, the lever 400 has a sloping portion 420, an engaged portion 422 and a slope 424. The sloping portion 420 is formed at a rear end of the support piece 410 and located rearward of the slope 414. The engaged portion 422 is formed at a rear side, or the negative Y-side, of the sloping portion 420, and the slope 424 is formed at a front side of the sloping portion 420. In other words, the sloping portion 420 is formed with the engaged portion 422 and the slope 424. The engaged portion 422 is a vertical plane perpendicular to the Y-direction, and the slope 424 intersects with both the Y-direction and the Z-direction.

As shown in FIGS. 10 and 12, the lever 400 has an engaged portion 430. The engaged portion 430 according to the present embodiment is a rear edge of the support piece 410 and is a vertical plane perpendicular to the Y-direction.

As shown in FIGS. 13 to 17, the slider 500 has a push-back mechanism (spring piece) 510. In other words, the connector 20 comprises the push-back mechanism 510. The push-back mechanism 510 according to the present embodiment is the spring piece 510 and is made of resin, wherein the spring piece 510 is integrally formed with the slider 500. The spring piece 510 may be formed separately from the slider 500 and subsequently fixed to the slider 500. The thus-formed spring piece 510 may be made of metal. However, in a view point of reducing the number of components, the spring piece 510 is preferred to be a part of the slider 500. Hereafter, explanation will be made about various parts of the spring piece 510 while using directions and positional relations under a state where the slider 500 is located at the second relative position.

Figure 16:
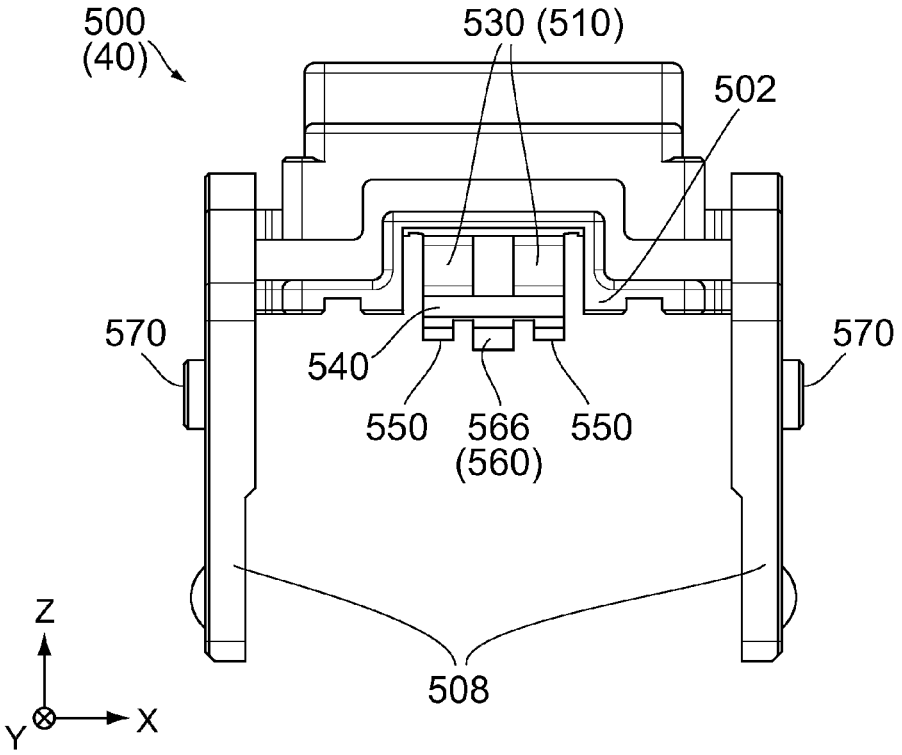
FIG. 16 is a rear view showing the slider of FIG. 13.
Figure 17:
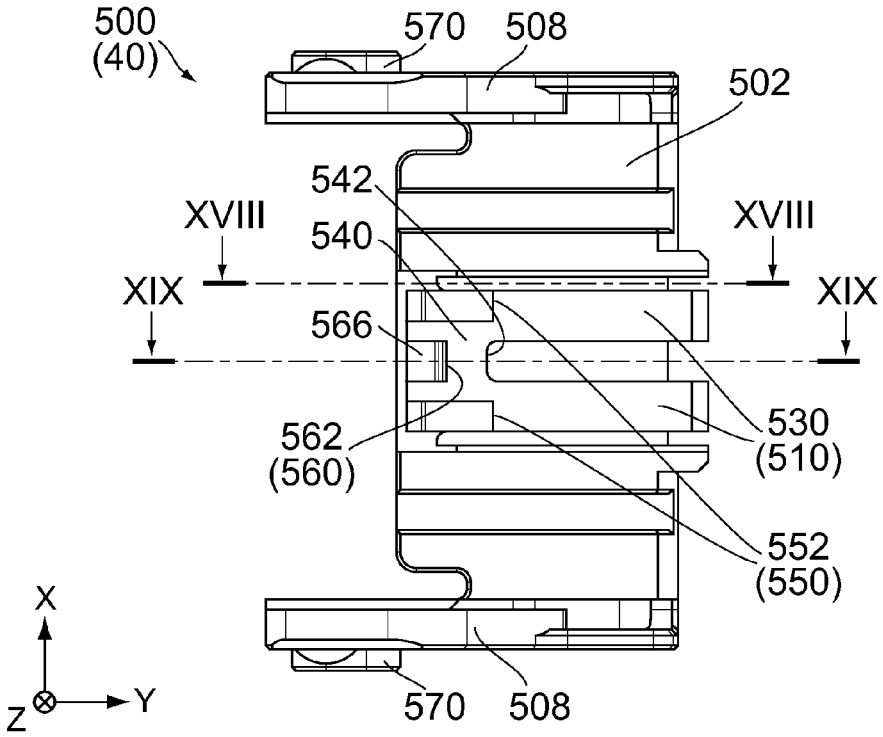
FIG. 17 is a bottom view showing the slider of FIG. 13.
Figure 18:
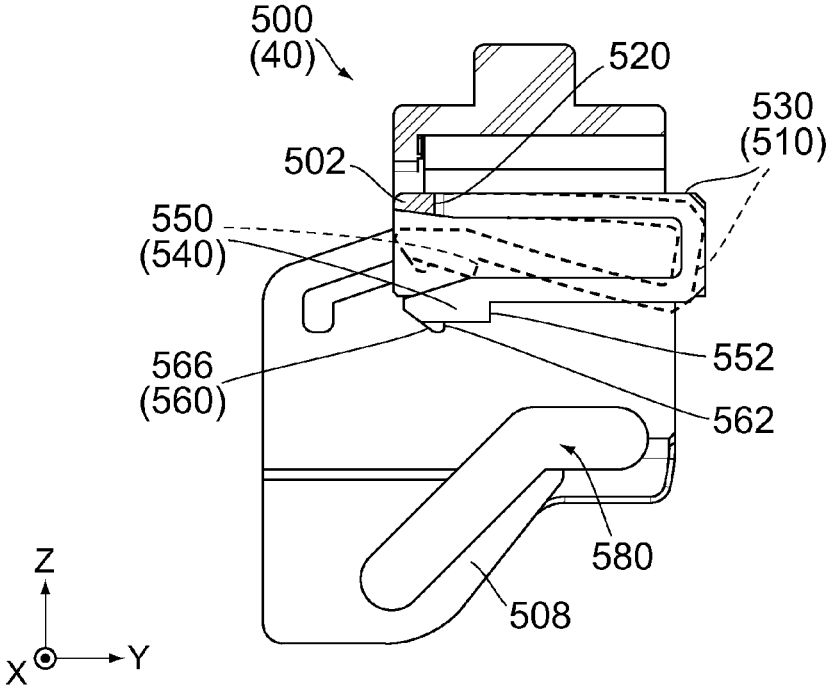
FIG. 18 is a cross-sectional view showing the slider of FIG. 17, taken along line XVIII-XVIII, wherein dashed line illustrates an outline of a spring piece of the slider which is resiliently deformed.
Figure 19:
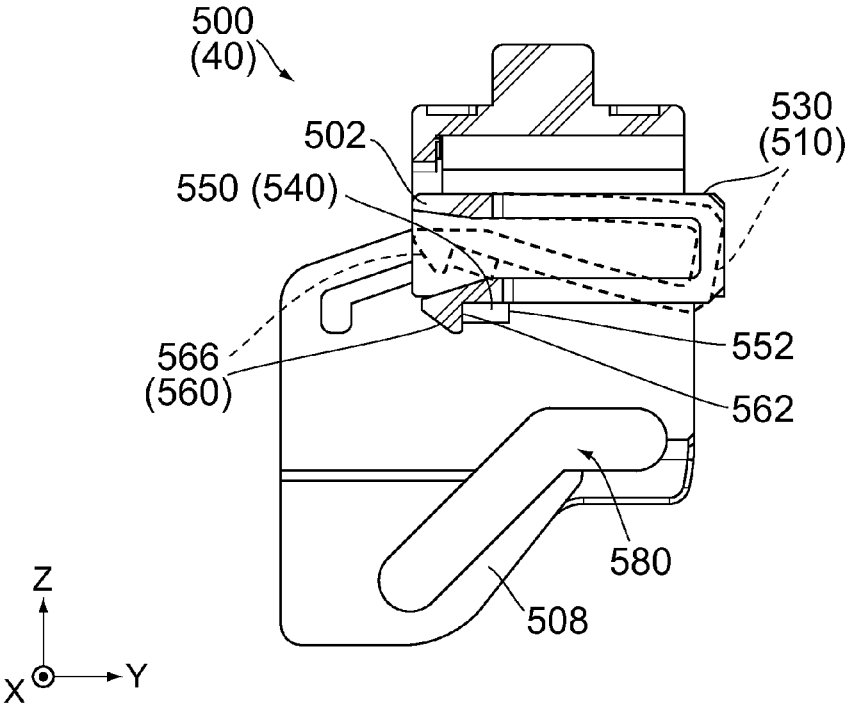
FIG. 19 is a cross-sectional view showing the slider of FIG. 17, taken along line XIX-XIX, wherein dashed line illustrates an outline of the spring piece which is resiliently deformed.

As shown in FIGS. 14, 16 and 17, the spring piece 510 has two spring portions 530 and a movable portion 540. Referring to FIG. 18, each of the spring portions 530 has a U-like shape in the YZ-plane. In detail, each of the spring portions 530 extends forward from its fixed end 520 fixed to the coupling portion 502, subsequently extends downward and subsequently extends rearward. In other words, the spring portion 530 is supported by the coupling portion 502 to be resiliently deformable. As shown in FIGS. 14, 16 and 17, the movable portion 540 couples free ends of the spring portions 530 in the X-direction. The movable portion 540 is movable in the Z-direction because of the resilient deformation of the spring portions 530. The movable portion 540 has a lower surface, or the negative Z-side surface, which is a horizontal plane when the spring portions 530 are not resiliently deformed.

As shown in FIGS. 14 and 17, the spring piece 510 has an engaging portion 542. The engaging portion 542 is formed at a frond end of the movable portion 540. The engaging portion 542 is located between the two spring portions 530 in the X-direction. When the spring portion 530 is not resiliently deformed, the engaging portion 542 is a vertical plane.

As shown in FIGS. 14, 16 and 17, the spring piece 510 has two engaging portions 552. In detail, the lower surface of the movable portion 540 is formed with two projecting portions 550. The projecting portions 550 are located at opposite sides of the movable portion 540 in the X-direction, respectively. The projecting portions 550 project downward from the movable portion 540. The engaging portions 552 are formed at the projecting portions 550, respectively. When the spring portions 530 are not resiliently deformed, each of the engaging portions 552 is a vertical plane.

The lower surface of the movable portion 540 is further formed with a projecting portion 560. The projecting portion 560 is located at a middle part of the movable portion 540 in the X-direction. The projecting portion 560 projects downward from the movable portion 540. The projecting portion 560 is formed with a front surface 562 and a slope 566. The front surface 562 is located at a front side of the projecting portion 560, and the slope 566 is located at a rear side of the projecting portion 560. When the spring portions 530 are not resiliently deformed, the front surface 562 is a vertical plane, and the slope 566 intersects with both the Y-direction and the Z-direction.

Figure 20:
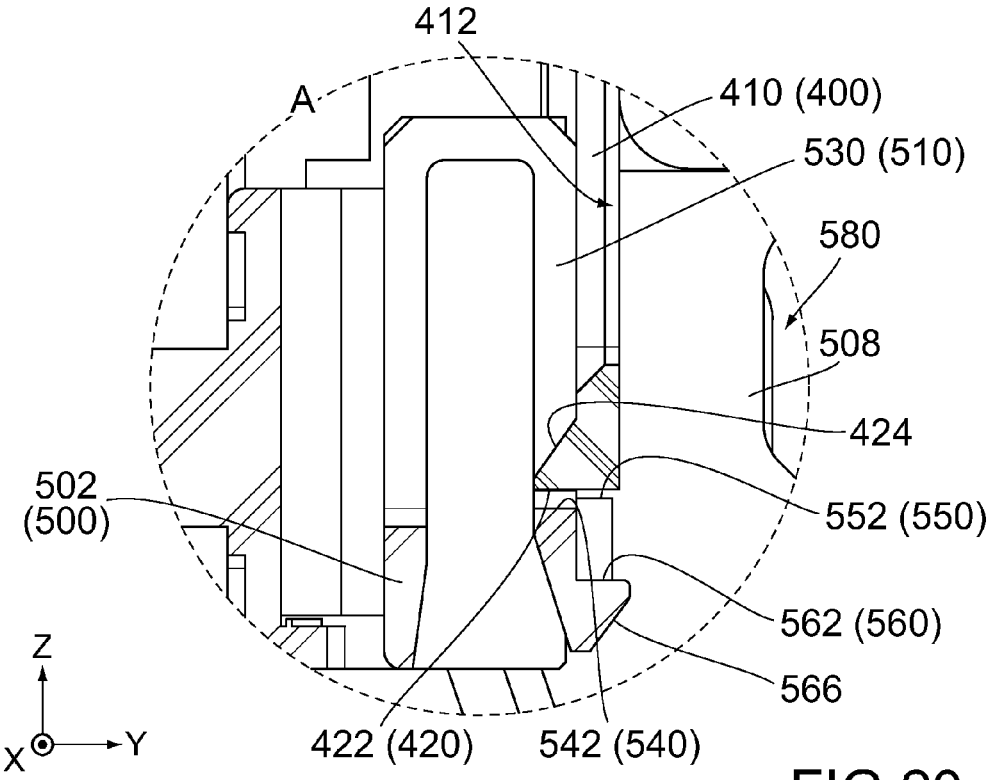
FIG. 20 is an enlarged, cross-sectional view showing the vicinity of the spring piece (the part encircled by dash line A) of the connector device of FIG. 3.

Referring to FIGS. 3 and 20, when the operation member 40 is in the initial state, the spring portions 530 of the spring piece 510 are not resiliently deformed. The shape of the spring piece 510 under this state is referred to as "initial shape". In other words, when the operation member 40 is in the initial state, the spring piece 510 has the initial shape.

As shown in FIG. 20, when the operation member 40 is in the initial state, the engaging portion 542 of the spring piece 510 is located under the engaged portion 422 of the lever 400. If the slider 500 is forced to be moved upward toward the second relative position, the engaging portion 542 is brought into abutment with the engaged portion 422. This abutment prevents the slider 500 from being moved to the second relative position. Moreover, as can be seen from FIGS. 12 and 20, when the operation member 40 is in the initial state, the engaging portions 552 of the spring pieces 510 are located under the engaged portion 430 of the lever 400. This positional relation also prevents the slider 500 from being moved to the second relative position. In other words, when the operation member 40 is in the initial state, the engaging portion 542 and the engaging portions 552 engage the engaged portion 422 and the engaged portion 430, respectively, to prevent the slider 500 from being moved from the first relative position to the second relative position.

Figure 21:
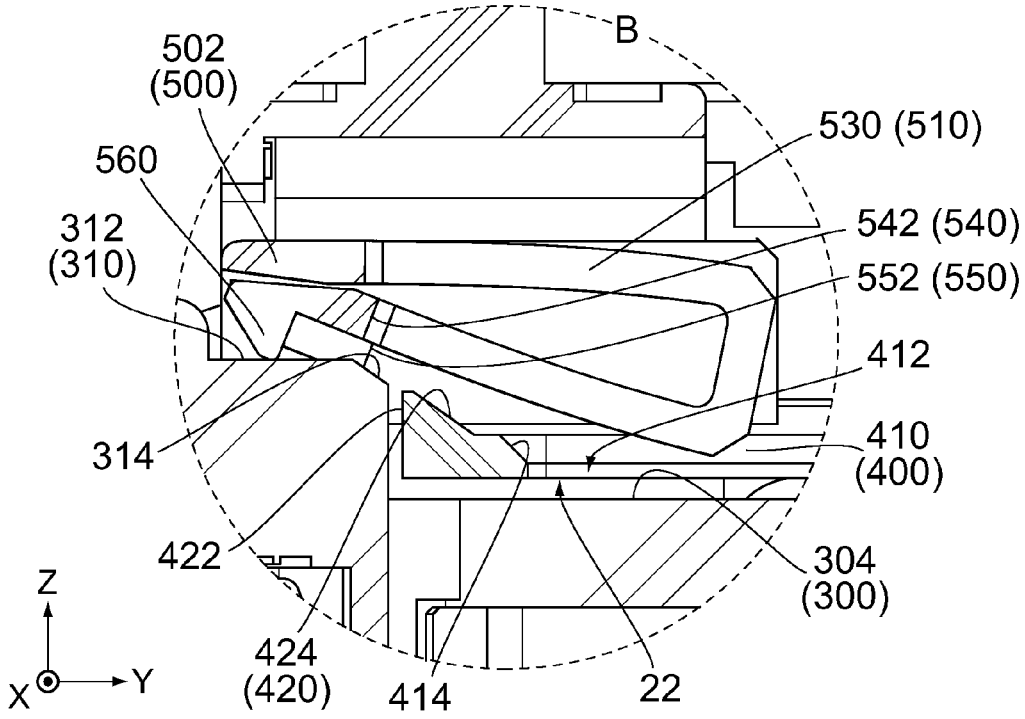
FIG. 21 is an enlarged, cross-sectional view showing the vicinity of the spring piece (the part encircled by dash line B) of the connector device of FIG. 5.
Figure 22:
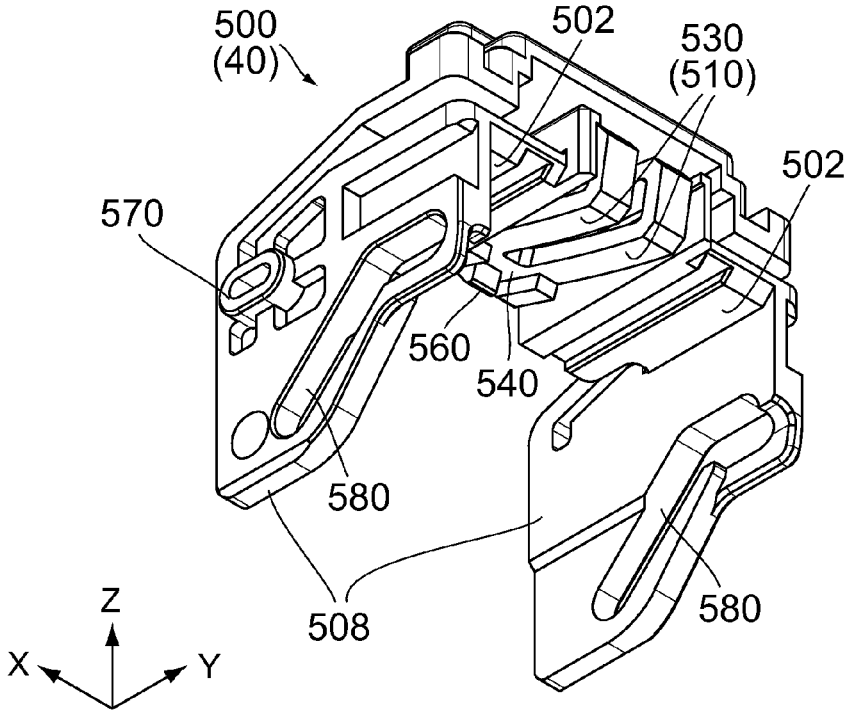
FIG. 22 is a perspective view showing the slider of the connector device of FIG. 21.

As can be seen from FIGS. 5 and 21, when the state of the operation member 40 is changed to the first state, the projecting portion 560 of the spring piece 510 is brought into abutment with the upper surface 312 of the projecting portion 310 of the housing 300. The projecting portion 560 is therefore pressed upward to be moved. Accordingly, as shown in FIGS. 21 and 22, when the state of the operation member 40 is changed to the first state, the spring piece 510 is resiliently deformed from the initial shape. The resiliently deformed spring piece 510 presses the projecting portion 310 downward.

As can be seen from FIGS. 5 and 21, when the state of the operation member 40 is changed from the initial state to the first state, the spring piece 510 applies a push-back force to the operation member 40, wherein the push-back force pushes back the operation member 40 to change the state of the operation member 40 back toward the initial state (the state shown in FIG. 3). However, during the operation of the operation member 40 by an operator, the operation applies an operation force to the operation member 40, wherein the operation force (maintaining force) can resist this push-back force. This maintaining force causes the operation member 40 to take a controlled posture shown in FIG. 5, or a posture extending along the Y-direction, while resiliently deforming the spring piece 510. In other words, under a condition where the operation member 40 is in the first state and the operation member 40 receives the maintaining force which resists the push-back force, the operation member 40 takes the controlled posture. According to the present embodiment, when the operation member 40 takes the controlled posture, the lever 400 is located at the second position.

Figure 24:
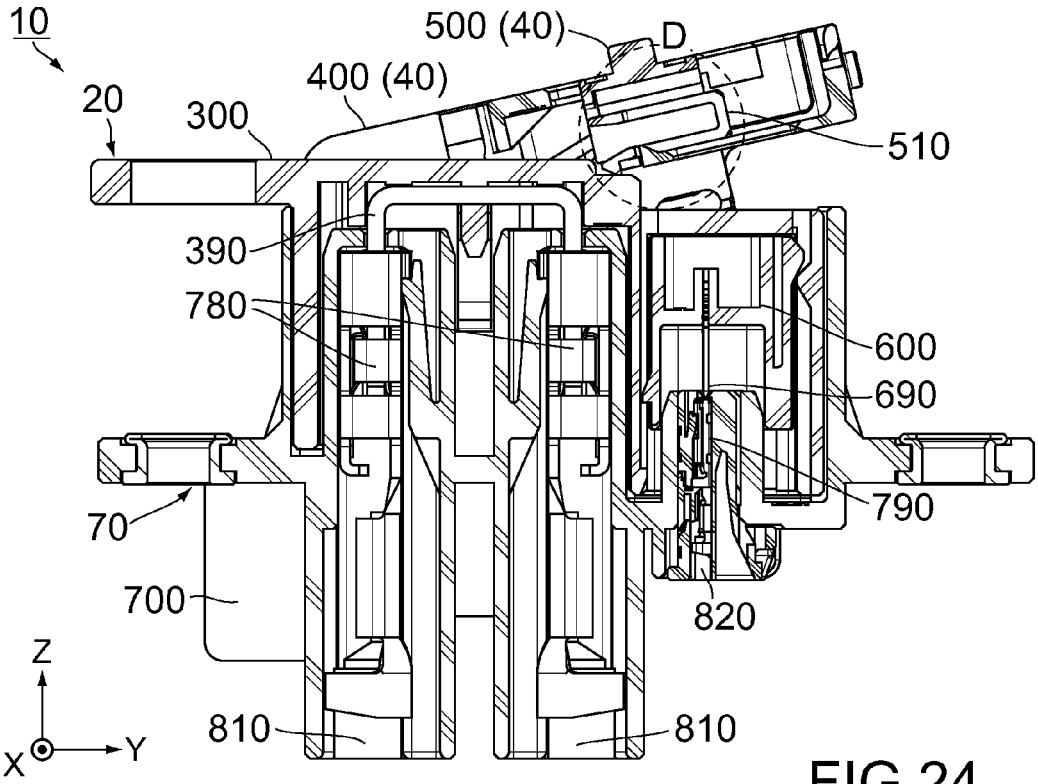
FIG. 24 is a partially cut-away view showing the connector device of FIG. 23, wherein illustrated cross-sections correspond to the cross-sections of FIG. 3.
Figure 28:
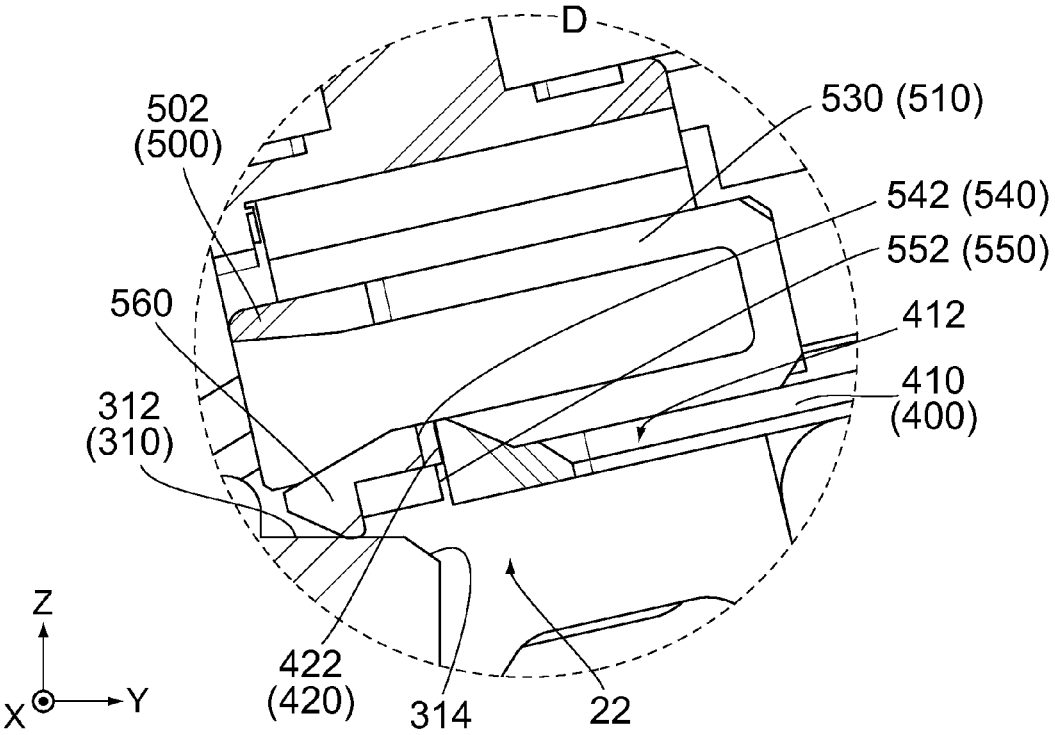
FIG. 28 is an enlarged, cross-sectional view showing the vicinity of the spring piece (the part encircled by dash line D) of the connector device of FIG. 24.
Figure 29A:
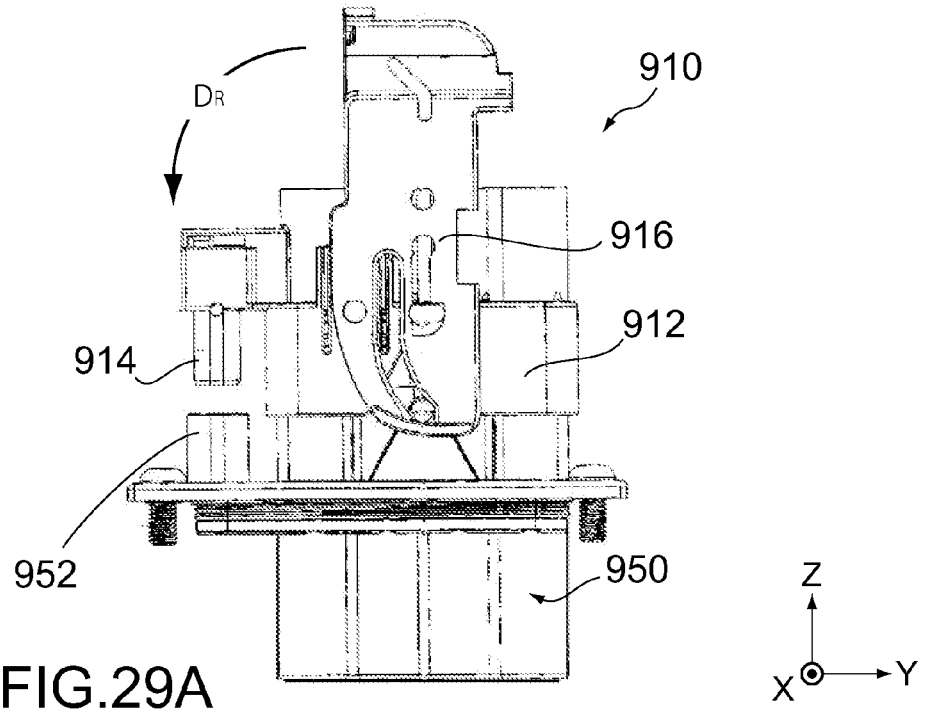
FIG.29A PRIOR ART
FIGS. 29A, 29B and 29C are side views each showing a connector device of Patent Document 1.
Figure 29B:
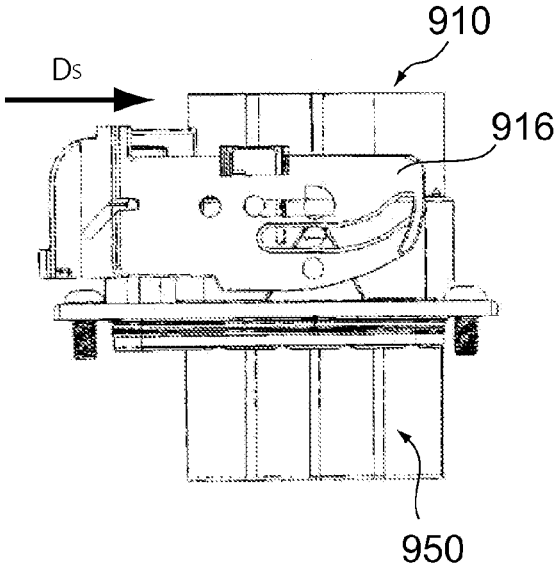
FIG.29B PRIOR ART
Figure 29C:
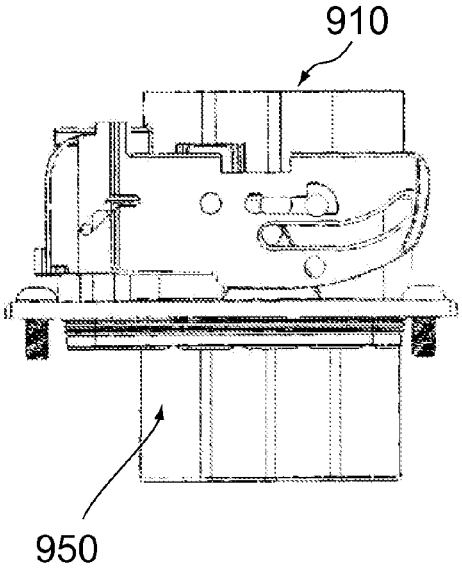
FIG.29C PRIOR ART

As can be seen from FIGS. 24 and 28, for example, if the operator temporarily suspends the operation of the operation member 40 and releases the operation member 40 from his/her hand, the operation member 40 receives no maintaining force. Moreover, referring to FIG. 25, when the operation member 40 is in the first state, each of the first cam projections 760 of the mating housing 700 is located in the vicinity of the corresponding support axis 370 of the housing 300 to allow the corresponding first cam groove 470 to be rotationally moved to some extent. Accordingly, the push-back force actually pushes back the operation member 40 and the state of the operation member 40 is changed toward the initial state (see FIG. 3).

Figure 25:
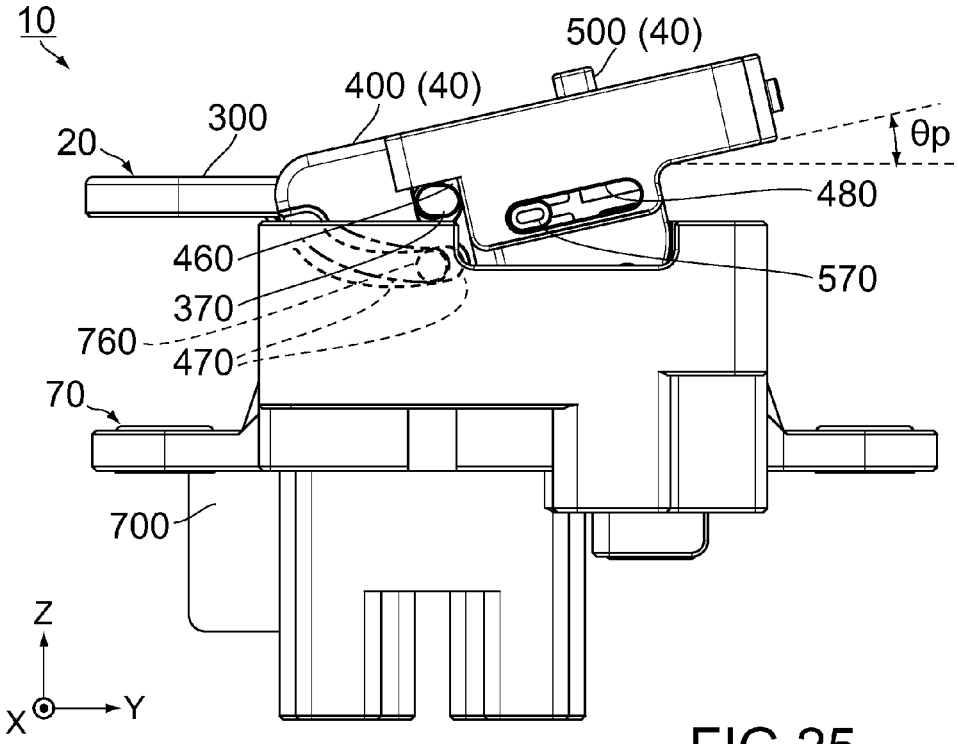
FIG. 25 is a side view showing the connector device of FIG. 23, wherein dashed line illustrates an outline of a part of the first cam groove of the lever hidden behind the mating connector and an outline of a first cam projection of the mating connector, and chain dotted line illustrates an outline of the first cam groove under a state where the operation member takes the controlled posture.
Figure 26:
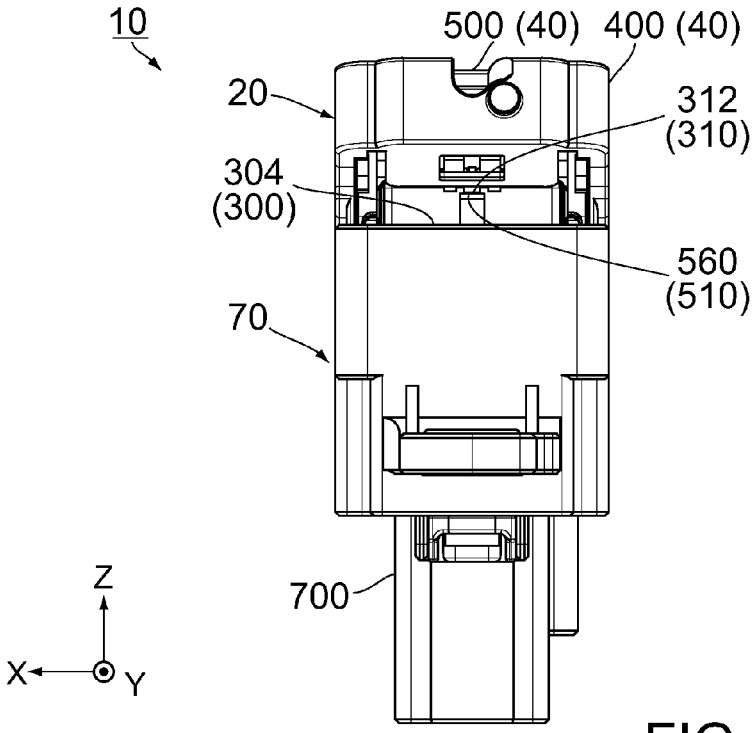
FIG. 26 is a front view showing the connector device of FIG. 23.

Referring to FIGS. 23 to 26, the operation member 40 in the first state extends obliquely upward from the housing 300 when receiving no maintaining force. The posture of the operation member 40 under this state is referred to as "released posture". In other words, under a condition where the operation member 40 is in the first state and the operation member 40 receives no maintaining force, the operation member 40 takes the released posture which is different from the controlled posture. Referring to FIG. 25, the operation member 40 intersects with the Y-direction at a predetermined intersection angle ($\theta p$) when taking the released posture. This predetermined intersection angle ($\theta p$) can be variously designed depending on modification of the level of the spring force of the spring piece 510 (see FIG. 22) as well as modification of the shape and the size of the first cam groove 470 of the lever 400.

Figure 23:
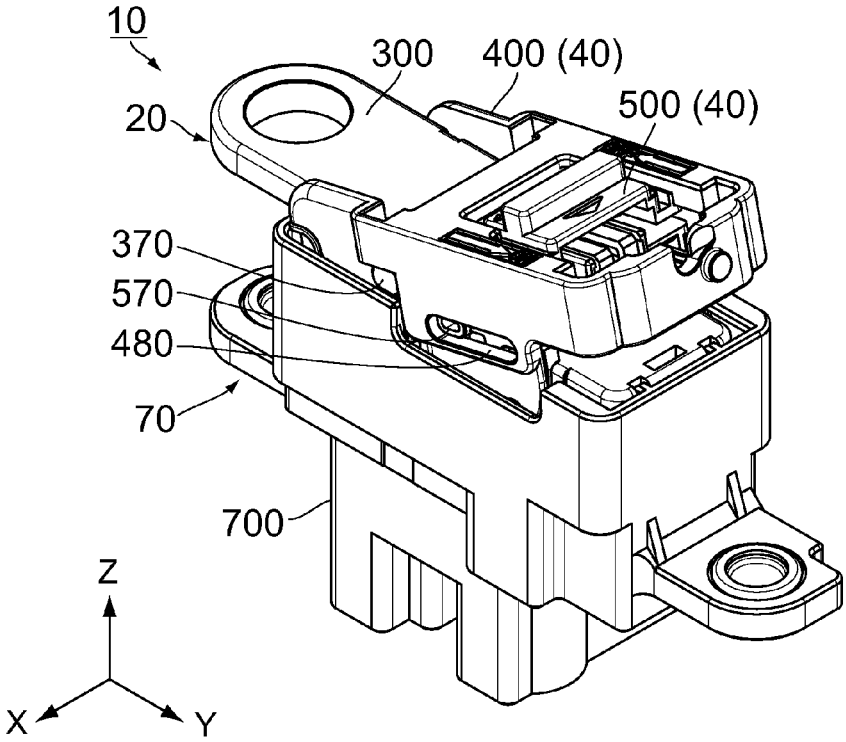
FIG. 23 is a perspective view showing the connector device of FIG. 1, wherein the operation member of the connector is in the first state while taking a released posture, and the cables extending outward from the mating connector are not illustrated.

Referring to FIGS. 4 and 23, the released posture, or the posture of the operation member 40 under a state where the operation is temporarily suspended, is clearly different from the controlled posture, or the posture of the operation member 40 during the operation. Accordingly, the operation member 40 can be easily visually checked whether the operation thereof is completed or not.

Referring to FIGS. 5 and 24, the push-back mechanism 510 according to the present embodiment is provided to the operation member 40. More specifically, the push-back mechanism 510 according to the present embodiment is the spring piece 510 provided to the slider 500. According to the present embodiment, when the state of the operation member 40 is changed to the first state, the push-back mechanism 510 presses the housing 300 to cause the aforementioned push-back force.

Referring to FIGS. 5 and 24, according to the present embodiment, the push-back mechanism 510 applies the push-back force indirectly to the lever 400 via the slider 500. However, for example, when the operation member 40 is formed only of the lever 400, the push-back mechanism 510 applies the push-back force directly to the lever 400. Thus, according to the present invention, the push-back mechanism 510 applies the push-back force directly or indirectly to the lever 400.

As can be seen from FIG. 28, if the operation of the operation member 40 is temporarily suspended under the first state, the engaging portion 542 and the engaging portions 552 of the slider 500 engage the engaged portion 422 and the engaged portion 430 (see FIG. 12) of the lever 400, respectively, to prevent the slider 500 from being moved from the first relative position to the second relative position. As can be seen from FIG. 21, when the operation member 40 during the operation is in the first state, the engaging portion 542 and the engaging portions 552 are moved upward to come off the engaged portion 422 and the engaged portion 430, respectively. The slider 500 can be therefore moved toward the second relative position. In other words, when the state of the operation member 40 is just changed to the first state, the engaging portion 542 and the engaging portions 552 allow the slider 500 to be moved from the first relative position to the second relative position. Similarly, when the suspended operation is resumed so that the operation member 40 in the first state takes back its controlled posture, the engaging portion 542 and the engaging portions 552 allow the slider 500 to be moved from the first relative position to the second relative position.

As shown in FIG. 21, when the state of the operation member 40 is changed to the first state, the sloping portion 420 of the lever 400 is located forward of and below the slope 314 of the projecting portion 310 of the housing 300. In detail, when the operation member 40 during the operation is in the first state, the slope 314 of the projecting portion 310 and the slope 424 of the sloping portion 420 roughly continuously extend with a narrow horizontal plane interposed therebetween.

Accordingly, when the slider 500 is moved toward the second relative position, the projecting portion 560 of the slider 500 is gradually moved downward. This gradual movement prevents generation of unnecessary click feeling which might be generated because of rapid and large resilient-deformation of the spring portions 530. In particular, each of the slope 314 and the slope 424 according to the present embodiment intersects with the Y-direction at about 45°. This intersection angle more surely prevents the click feeling from being generated.

Figure 27:
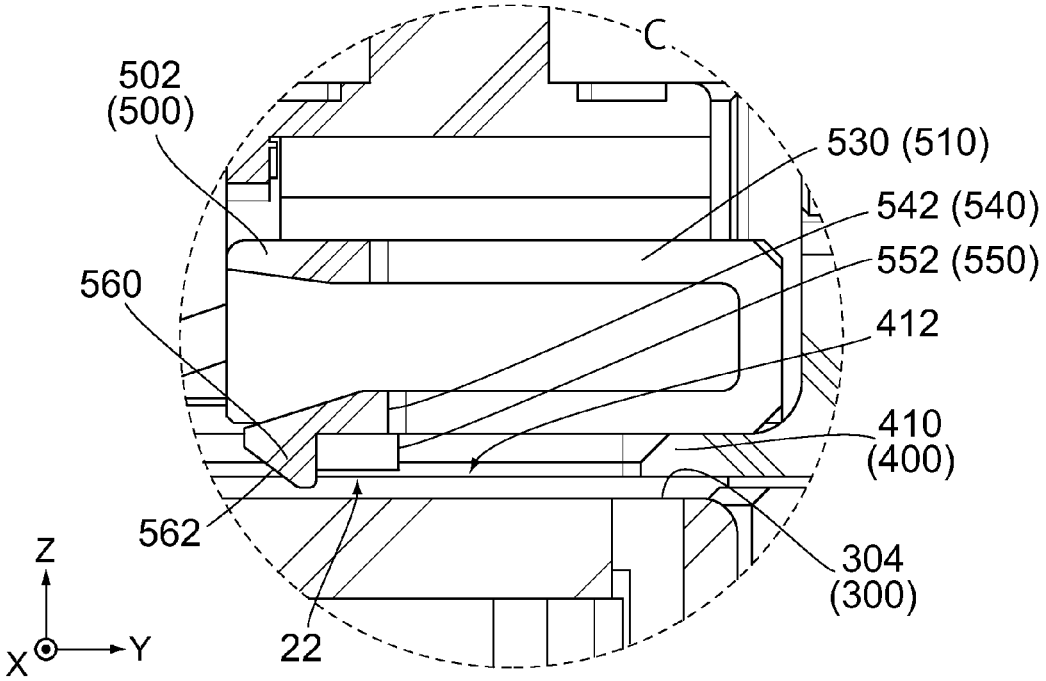
FIG. 27 is an enlarged, cross-sectional view showing the vicinity of the spring piece (the part encircled by dash line C) of the connector device of FIG. 7.

As can be seen from FIGS. 21 and 27, when the slider 500 of the operation member 40 in the first state is moved to the second relative position, the projecting portion 560 passes the sloping portion 420 and arrives at the receiving portion 412. At that time, the projecting portion 560 is received into the receiving portion 412 and the receiving space 22 of the housing 300. In detail, as shown in FIG. 27, when the slider 500 is located at the second relative position, a lower end of the projecting portion 560 projects downward while passing through the receiving portion 412. According to the present embodiment, since the receiving space 22 is provided under the receiving portion 412, the spring piece 510 is partially received in the receiving space 22 and returns to the initial shape. Accordingly, the spring property of each of the spring portions 530 of the spring piece 510 can be kept even if the slider 500 is maintained at the second relative position for a long time. It is sufficient that the spring piece 510 is received, at least in part, in the receiving space 22, provided that the spring property can be kept.

As can be seen from FIG. 21, the slope 424 and the slope 414 also roughly continuously extend with a narrow horizontal plane interposed therebetween. Accordingly, also when the projecting portion 560 is received into the receiving space 22, the projecting portion 560 is not largely moved downward. This structure also prevents the unnecessary click feeling from being generated.

Referring to FIGS. 21 and 27, when the slider 500 is located at the second relative position, the front surface 562 of the projecting portion 560 is inclined similar to the slope 314, the slope 424 and the slope 414. Accordingly, the slider 500 can be smoothly moved back to the first relative position from the second relative position.

The connector device 10 according to the present invention can be further variously modified in addition to the already explained modifications. For example, the push-back mechanism 510 may push back not whole of the operation member 40 but a part of the operation member 40, for example, only the slider 500. However, in a view point of easy visual check on whether the operation member 40 is in the first state, the operation member 40 is preferred to be totally pushed back.

Moreover, the portion provided to the support piece 410 in the present embodiment, such as the receiving portion 412, may be provided to a part other than the support piece 410. Moreover, the shape and the size of the spring piece 510 can be variously modified. Moreover, the push-back mechanism 510 may have any structure, provided that the operation member 40 which changes its state to the first state applies the push-back force to the operation member 40. For example, the push-back mechanism 510 does not need to be the spring piece 510.

The push-back mechanism 510 may be provided to a member other than the slider 500. For example, the push-back mechanism 510 may be a part of the lever 400. Even in this case, the push-back mechanism 510, or the spring piece 510, may be pressed by the housing 300 to be resiliently deformed similar to the aforementioned embodiment when the state of the operation member 40 is changed to the first state. However, the lever 400 is unmoved relative to the housing 300 when the state of the operation member 40 is changed from the first state to the second state. The spring piece 510 provided to the lever 400 is therefore kept to be pressed by the housing 300 and kept to be resiliently deformed even when the operation member 40 is maintained in the second state. This persistent, resilient deformation might degrade the spring property of the spring piece 510. Under a condition where the spring piece 510 works as the push-back mechanism 510 and the spring property of the spring piece 510 very needs to be kept, the spring piece 510 is preferred to be provided to one of the slider 500 and the housing 300 which change their positional relation relative to each other in association with the change of the state of the operation member 40 from the first state to the second state. The spring piece 510 thus-provided to one of the slider 500 and the housing 300 presses a remaining one of the slider 500 and the housing 300 to cause the push-back force when the state of the operation member 40 is changed to the first state.

The present application is based on a Japanese patent application of JP2014-166462 filed before the Japan Patent Office on Aug. 19, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector device comprising a connector and a mating connector connectable with each other, wherein:

the mating connector comprises a mating housing, a mating primary terminal and a mating secondary terminal;

the mating primary terminal and the mating secondary terminal are held by the mating housing;

the connector comprises a housing, a primary terminal, a secondary terminal, an operation member and a push-back mechanism;

the primary terminal is held by the housing;

the operation member is attached to the housing;

a movement of a part or whole of the operation member relative to the housing causes a state of the operation member to be changed from an initial state to a first state, and another movement of a part or whole of the operation member relative to the housing causes the state of the operation member to be changed from the first state to a second state;

when the operation member is in the initial state, the primary terminal is unconnected to the mating primary terminal, and the secondary terminal is unconnected to the mating secondary terminal;

when the state of the operation member is changed from the initial state to the first state, the primary terminal is moved relative to the mating primary terminal to be connected to the mating primary terminal;

when the state of the operation member is changed from the first state to the second state, the secondary terminal is moved relative to the mating secondary terminal to be connected to the mating secondary terminal; and when the state of the operation member is changed to the first state, the push-back mechanism applies a push-back force to the operation member, wherein the push-back force pushes back the operation member to change the state of the operation member back toward the initial state.

2. The connector device as recited in claim 1, wherein:

under a condition where the operation member is in the first state and the operation member receives a maintaining force which resists the push-back force, the operation member takes a controlled posture; and under another condition where the operation member is in the first state and the operation member receives no maintaining force, the operation member takes a released posture which is different from the controlled posture.

3. The connector device as recited in claim 1, wherein:

the push-back mechanism is provided to the operation member; and when the state of the operation member is changed to the first state, the push-back mechanism presses the housing to cause the push-back force.

4. The connector device as recited in claim 1, wherein:

the operation member includes a lever and a slider;

the lever is attached to the housing and is movable between a first position and a second position each of which is a position relative to the housing;

the slider is attached to the lever and is movable between a first relative position and a second relative position each of which is a position relative to the lever;

when the operation member is in the initial state, the lever is located at the first position and the slider is located at the first relative position;

when the state of the operation member is changed to the first state, the lever is moved to the second position;

when the state of the operation member is changed to the second state, the slider is moved to the second relative position; and the push-back mechanism applies the push-back force directly or indirectly to the lever, wherein the push-back force pushes the lever back toward the first position.

5. The connector device as recited in claim 4, wherein:

the push-back mechanism is provided to one of the slider and the housing; and when the state of the operation member is changed to the first state, the push-back mechanism presses a remaining one of the slider and the housing to cause the push-back force.

6. The connector device as recited in claim 5, wherein the push-back mechanism is provided to the slider.

7. The connector device as recited in claim 6, wherein the push-back mechanism is a spring piece which is integrally formed with the slider.

8. The connector device as recited in claim 7, wherein:

the connector is provided with a receiving space;

when the operation member is in the initial state, the spring piece has an initial shape;

when the state of the operation member is changed to the first state, the spring piece is resiliently deformed from the initial shape; and when the slider of the operation member in the first state is moved to the second relative position, the spring piece is received, at least in part, in the receiving space to return to the initial shape.

9. The connector device as recited in claim 7, wherein:

when the state of the operation member is changed from the first state to the second state, the slider is moved forward in a front-rear direction from the first relative position to the second relative position;

the housing is provided with a projecting portion which projects upward in an upper-lower direction perpendicular to the front-rear direction;

when the state of the operation member is changed to the first state, the spring piece presses the projecting portion downward;

the projecting portion has a front side formed with a slope;

the lever has a sloping portion formed with a slope; and when the state of the operation member is changed to the first state, the sloping portion is located forward of and below the slope of the projecting portion.

10. The connector device as recited in claim 7, wherein:

the spring piece has an engaging portion;

the lever has an engaged portion;

when the operation member is in the initial state, the engaging portion engages the engaged portion to prevent the slider from being moved from the first relative position to the second relative position; and when the state of the operation member is changed to the first state, the engaging portion, which comes off the engaged portion, allows the slider to be moved from the first relative position to the second relative position.

* * * * *